US006397728B1

(12) United States Patent
Barber

(10) Patent No.: US 6,397,728 B1
(45) **Date of Patent: *Jun. 4, 2002**

(54) LINEAR STOPPING AND POSITIONING APPARATUS

(76) Inventor: Steven C. Barber, 24395 Wood Dr., Shorewood, MN (US) 55331

( * ) Notice: Subject to any disclaimer, the term of this patent is extended or adjusted under 35 U.S.C. 154(b) by 0 days.

This patent is subject to a terminal disclaimer.

(21) Appl. No.: 09/395,780

(22) Filed: Sep. 14, 1999

Related U.S. Application Data

(63) Continuation-in-part of application No. 08/967,461, filed on Nov. 11, 1997, now Pat. No. 5,950,790.

(51) Int. Cl.[7] ..... F01B 29/00
(52) U.S. Cl. ..... 92/88; 92/137; 92/18
(58) Field of Search ..... 92/88, 137, 18, 92/20, 28; 192/138, 139; 74/817, 526

(56) References Cited

U.S. PATENT DOCUMENTS

| | | | | |
|---|---|---|---|---|
| 512,313 | A | | 1/1894 | McDonald |
| 1,038,636 | A | | 9/1912 | Oxnard |
| 1,447,242 | A | | 3/1923 | Fritz |
| 1,809,615 | A | | 6/1931 | Wilson |
| 1,845,797 | A | | 2/1932 | Kearney |
| 2,038,595 | A | | 4/1936 | Noble |
| 2,627,846 | A | | 2/1953 | Boedeker |
| 2,692,693 | A | | 10/1954 | Newburg |
| 2,828,722 | A | | 4/1958 | Bohnhoff et al. |
| 2,893,353 | A | | 7/1959 | Short, Jr. et al. |
| 3,010,587 | A | | 11/1961 | Hollinger |
| 3,094,883 | A | | 6/1963 | Junge et al. |
| 3,477,229 | A | | 11/1969 | Katko |
| 3,568,559 | A | | 3/1971 | Fink |
| 3,592,131 | A | | 7/1971 | Harvey et al. |
| 3,822,635 | A | | 7/1974 | Nishimura |
| 3,941,141 | A | | 3/1976 | Robert |
| 4,020,745 | A | | 5/1977 | Iijima et al. |
| 4,351,628 | A | | 9/1982 | Drexel et al. |
| 4,409,888 | A | | 10/1983 | Weyer |
| 4,829,880 | A | | 5/1989 | Lieberman |
| 4,898,080 | A | | 2/1990 | Lieberman |
| 5,117,739 | A | | 6/1992 | Maher et al. |
| 5,190,263 | A | | 3/1993 | Roberts |
| 5,293,812 | A | | 3/1994 | Makl et al. |
| 5,297,470 | A | | 3/1994 | Niederstadt et al. |
| 5,347,914 | A | * | 9/1994 | Kinoshita et al. ..... 92/88 |
| 5,570,769 | A | | 11/1996 | Eicher et al. |
| 5,950,790 | A | | 9/1999 | Barber |

* cited by examiner

*Primary Examiner*—Hoang Nguyen
(74) *Attorney, Agent, or Firm*—James V Harmon

(57) ABSTRACT

A linear positioning apparatus has a positioning actuator assembly including a cylinder and movable piston to be used for moving a workpiece or a moveable worktable along a rectilinear path or thrust axis. The apparatus includes at least one stop member adjustably mounted on a support such as a plate or hub. To stop the worktable at a selected stop point, each stop member can be positioned to engage an object, for convenience referred to herein as a bumper, that is connected to the moveable worktable to halt movement when the correct position has been reached. The apparatus includes means such as an actuator operatively associated to provide relative aligning movement between the stop member and bumper for placing the bumper and a selected one of the stop members in alignment with each other. The support for the stop member, e.g., a plate or hub, includes a bore or passage that extends entirely through it for each stop member so that each stop member can project out through both sides of the support. Consequently, the stop member can be fully retracted or extended its full length with respect to the support.

21 Claims, 16 Drawing Sheets

66a
66
80
64
52
64a
64b
80a
80b

LINEAR STOPPING AND POSITIONING APPARATUS

This application is a CIP of 08/967,461 filed Nov. 11, 1997 now U.S. Pat. No. 5,950,790.

FIELD OF THE INVENTION

This invention relates to a linear stopping and positioning apparatus. The invention is especially suited for stopping and locating the carriage of a pneumatic actuator at one or more selected positions.

BACKGROUND OF THE INVENTION

In the field of robotics and factory automation, high-speed, accurate multiple positioning of a workpiece is a common requirement. Hydraulics have been previously used but hydraulic systems are expensive and any leakage of hydraulic fluids produces a contamination problem which can not be tolerated in many applications including food packaging, biomedical assembly, electronics manufacturing or environments requiring clean-room conditions. In comparison to hydraulic systems, pneumatic systems are very cost-effective, are easily understood and maintained, and can be operated by a broad range of personnel. However, because air is compressible, pneumatic actuators alone are incapable of accurately positioning a workpiece in any more than the terminal positions, i.e. their fully-extended and fully-retracted positions, at the end of each stroke. Currently there is a high demand for systems that are capable of accurately and repeatably positioning a workpiece at multiple locations. Typically, stepper motors or servo motors are combined with a ball-screw and linear actuator to produce such a positioning system. While these systems are quite accurate and produce repeatable results, they are very expensive and require a highly-skilled operator to integrate, setup, debug and run them. It is a general objective of this invention to provide a simpler, less costly but highly accurate positioning system.

A cost-effective, accurate and repeatable mid-stroke stopping and positioning method using pneumatics has not been successfully achieved by the prior art. Attempts have been made in the past, for example in U.S. Pat. Nos. 4,829,880 and 4,898,080, to locate a workpiece at any of several pre-set stop points but these attempts have not been successful. In the patented device a magnet is used to position a pivoted latching arm but this system has inherent weaknesses that have made it commercially unacceptable. First, pneumatic actuators have the ability to produce several hundred pounds of force. Therefore, the stopping mechanism must be robust enough to withstand these forces and still maintain accuracy and repeatability. In addition, once the worktable reaches a pre-set stop point, the pivoted latching arm used in the patented device becomes locked in place by the worktable. Therefore, the worktable must be backed off (moved in the reverse direction) to clear the latch, in order to allow forward motion to continue. Moreover, commercial products made under these patents did not have sufficient positioning accuracy or repeatability to meet the demanding requirements of the automation industry. In addition, there was no positive mechanical member holding the latch arm in an extended position.

In view of these and other shortcomings of the prior art, it is one object of the invention to provide a positive linear pneumatic positioning system capable of locating a worktable in one or any of a plurality of linearly arranged stop positions with an accuracy up to 0.001 inch to assure precision placement and assembly of parts held on the worktable.

Another object is to enable the workpiece to continue motion in a given direction after stopping without having to first back off in the reverse direction.

Still another object is to find a way of moving both the worktable and the stop arm using standard parts, namely, pneumatic actuators each consisting of a cylinder and a piston assembly that is commercially available.

A further object is to provide a positive linear positioning and stopping system that has the capability of advancing to the next pre-set position in a sequential manner or to advance to any of a plurality of pre-set positions in a random manner.

Another object is to provide both unidirectional as well as bi-directional positioning capabilities.

In addition, an object of the invention is to be easily adaptable to any of the various linear pneumatic actuator configurations that are commercially available today.

A further, more specific object is to provide a positive linear pneumatic positioning system that uses a first pneumatic cylinder and piston assembly for moving a worktable and a second pneumatic indexing cylinder and piston assembly for selecting a stop member that is to be placed in an operating position.

Another object is to provide a positive mechanical element for locking a selected stop member in an extended operating position.

These and other more detailed and specific objects of the present invention will be better understood by reference to the following figures and detailed description which illustrate by way of example but a few of the various forms of the invention within the scope of the appended claims.

SUMMARY OF THE INVENTION

This invention provides a positive linear stopping and positioning apparatus that employs an actuator including a cylinder and a movable piston for moving a worktable along a rectilinear path. One aspect of the invention is the provision of a second actuator comprising a cylinder and piston combination for moving a selected one of a plurality of stop members to an operating or stopping position adapted to engage the worktable and hold it at a predetermined precisely positioned stop point.

Another aspect of the invention is the provision of a locking mechanism for positively and mechanically locking a selected stop arm in an operating position adapted to stop the worktable at a selected stop point.

Still another aspect of the invention is the provision of a single movable member that serves both as a stop arm actuator or extender and a stop arm locking member for positively and mechanically locking a selected stop arm in an operating position.

Yet another feature of the invention is a means for indexing a movable member one or more times to select a particular one of several stop points where the worktable is intended to stop.

A further aspect of the invention is the provision of a positioning system for a pneumatic actuator that includes a plurality of linearly distributed stop assemblies with a movable indexing shaft that extends between all of the stop assemblies and is operatively associated with each of the stop assemblies for sequentially or randomly placing a stop arm located at each of the stop assemblies in an operating position and for halting the movement of the indexing shaft when a selected stop arm is in an operating position.

Yet another, more specific, feature of the invention is the provision of an indexing shaft that rotates for selecting a stop point and is moved in a different way to extend a selected stop arm to an operating position.

The invention also provides a positive linear positioning and stopping system that can be retrofitted for use with a commercially available pneumatic actuator cylinder containing a movable piston for moving a worktable or workpiece along a rectilinear path. The invention is well adapted to include or to be used with several pneumatic actuator types including, but not limited to, band cylinders, magnetically coupled cylinders, slide-type cylinders, and rod-type cylinders.

The invention is also useful for locating other kinds of moving machine elements in addition to pneumatic actuators, e.g. for locating a movable machine element in any of a plurality of selected positions. In this application the invention can be used as a back gauge for a press brake or shear or for locating the cutting head of a milling machine, drill press, cut-off saw or similar machine that employs an operating head that requires positioning in any of several selected positions or in which the position, e.g., the height, of a machine operating table is to be positioned in one or a plurality of selected stop points. Each of the selected stop points can be pre-set manually in any of an infinitely variable number of positions.

THE FIGURES

FIGS. 5A–D are horizontal cross-sectional views of one of the stop assemblies showing the progressive extension of the stop arm.

Figure 6:
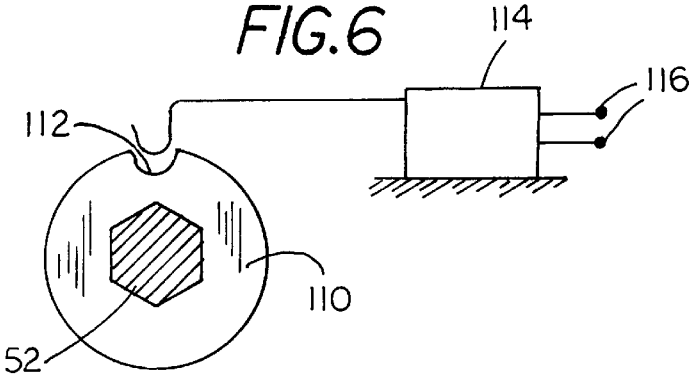

FIG. 6 is a diagrammatic vertical sectional view showing the homing switch assembly.

Figure 7:
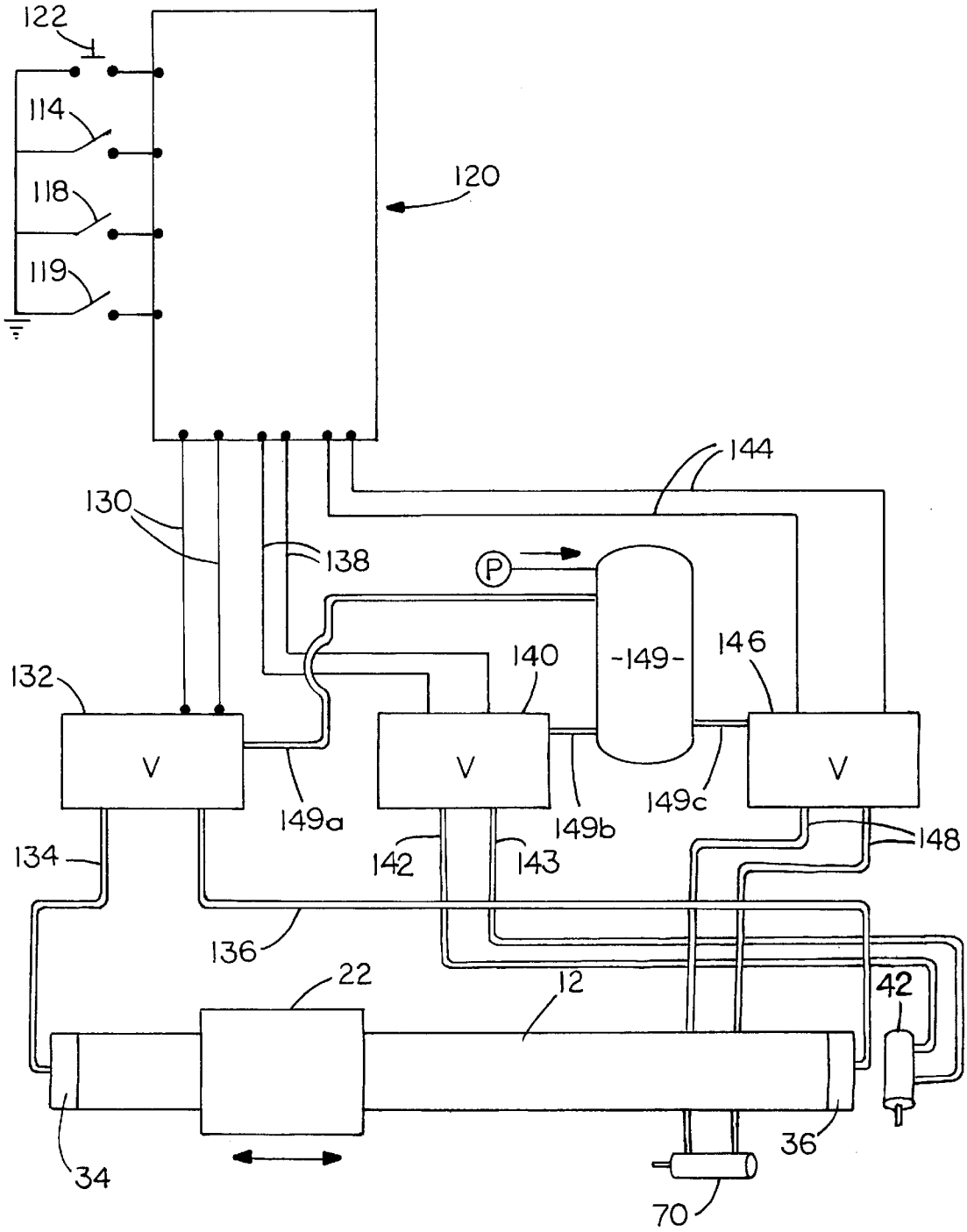

FIG. 7 is a schematic view of a programmable logic controller for controlling the operation of the invention.

Figures 8, 8A:
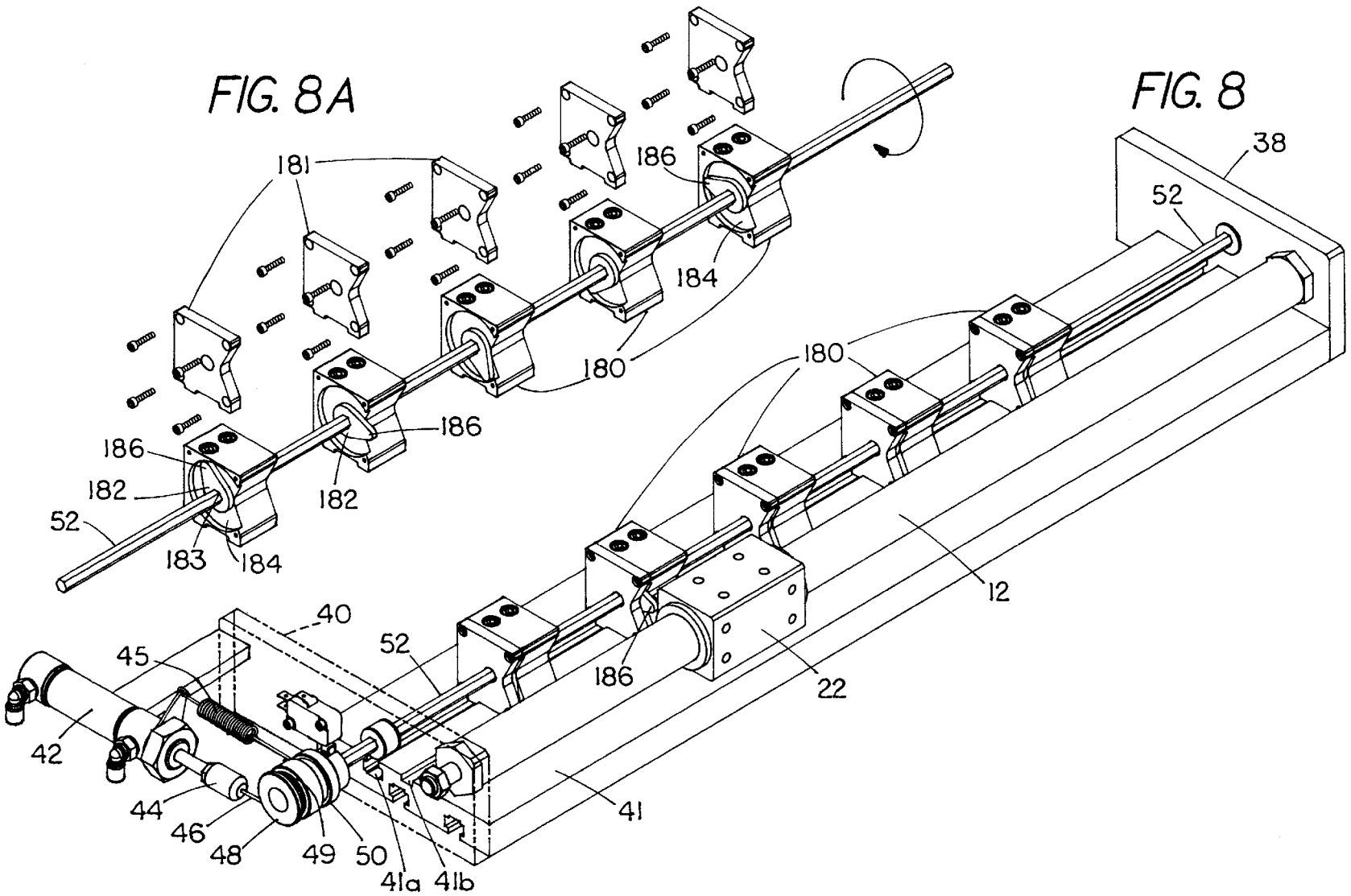

FIG. 8 is a perspective view of the invention using another form of stop assembly.

FIG. 8A is an exploded view of FIG. 8.

Figure 9:
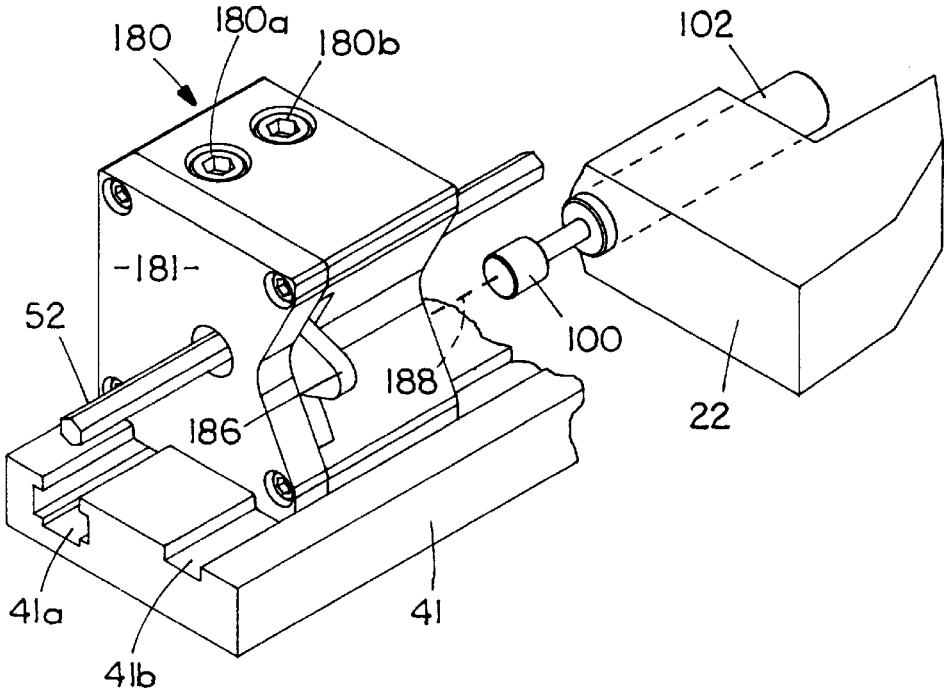

FIG. 9 is a perspective view on a larger scale of one of the stop blocks shown in FIGS. 8 and 8A.

Figure 9A:
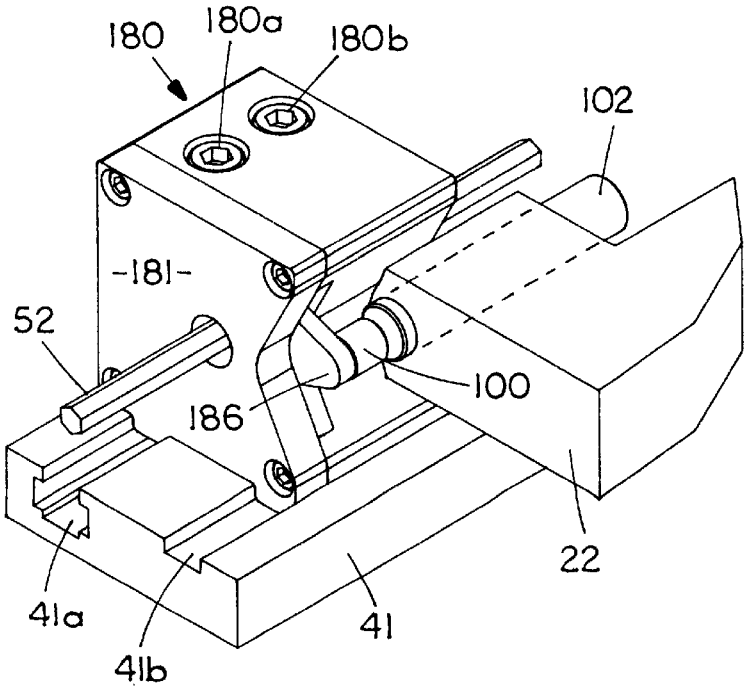

FIG. 9A is a view similar to FIG. 9 showing the stop block in operation.

Figures 10, 10A:
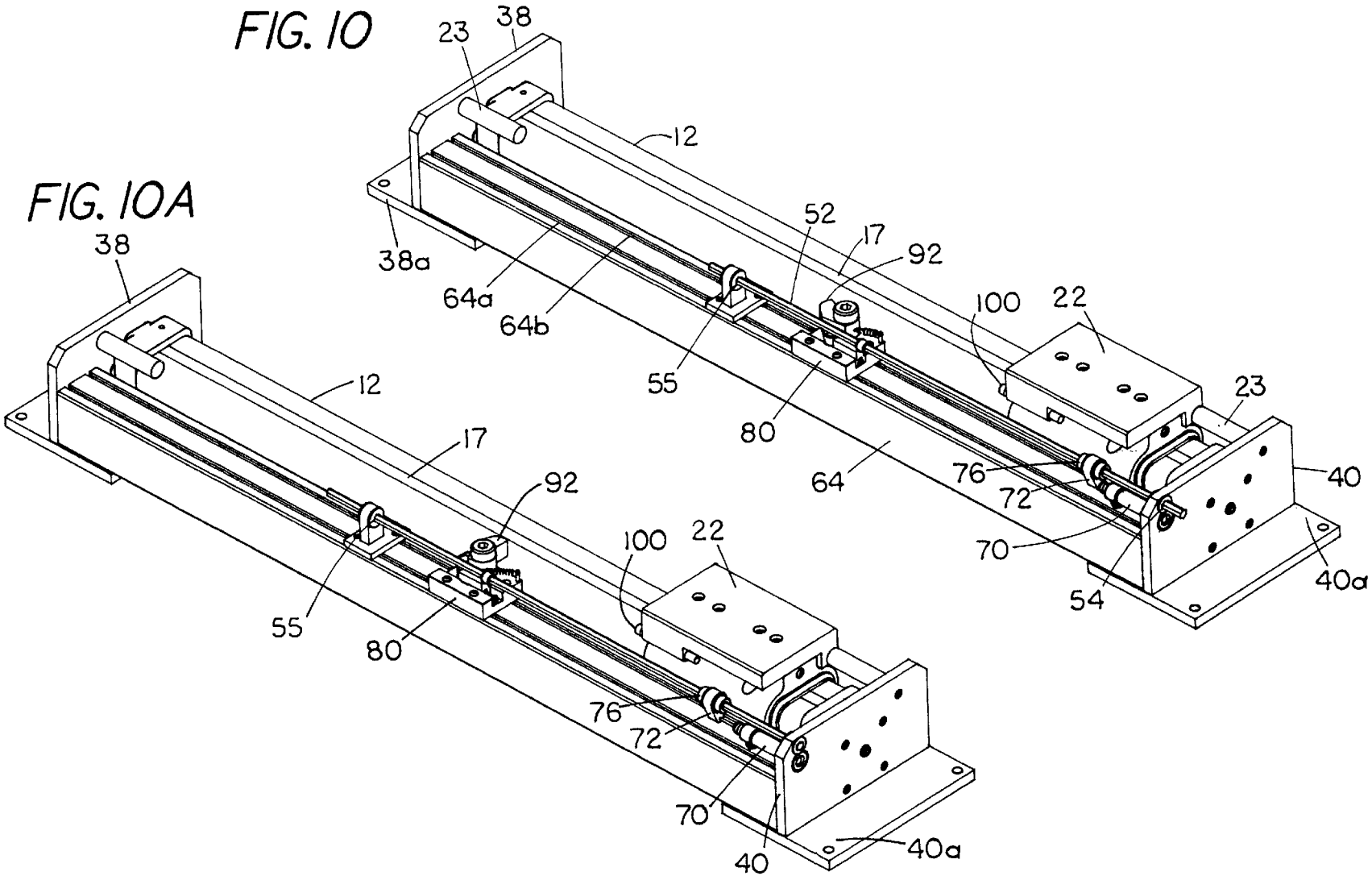
Figures 10B, 11:
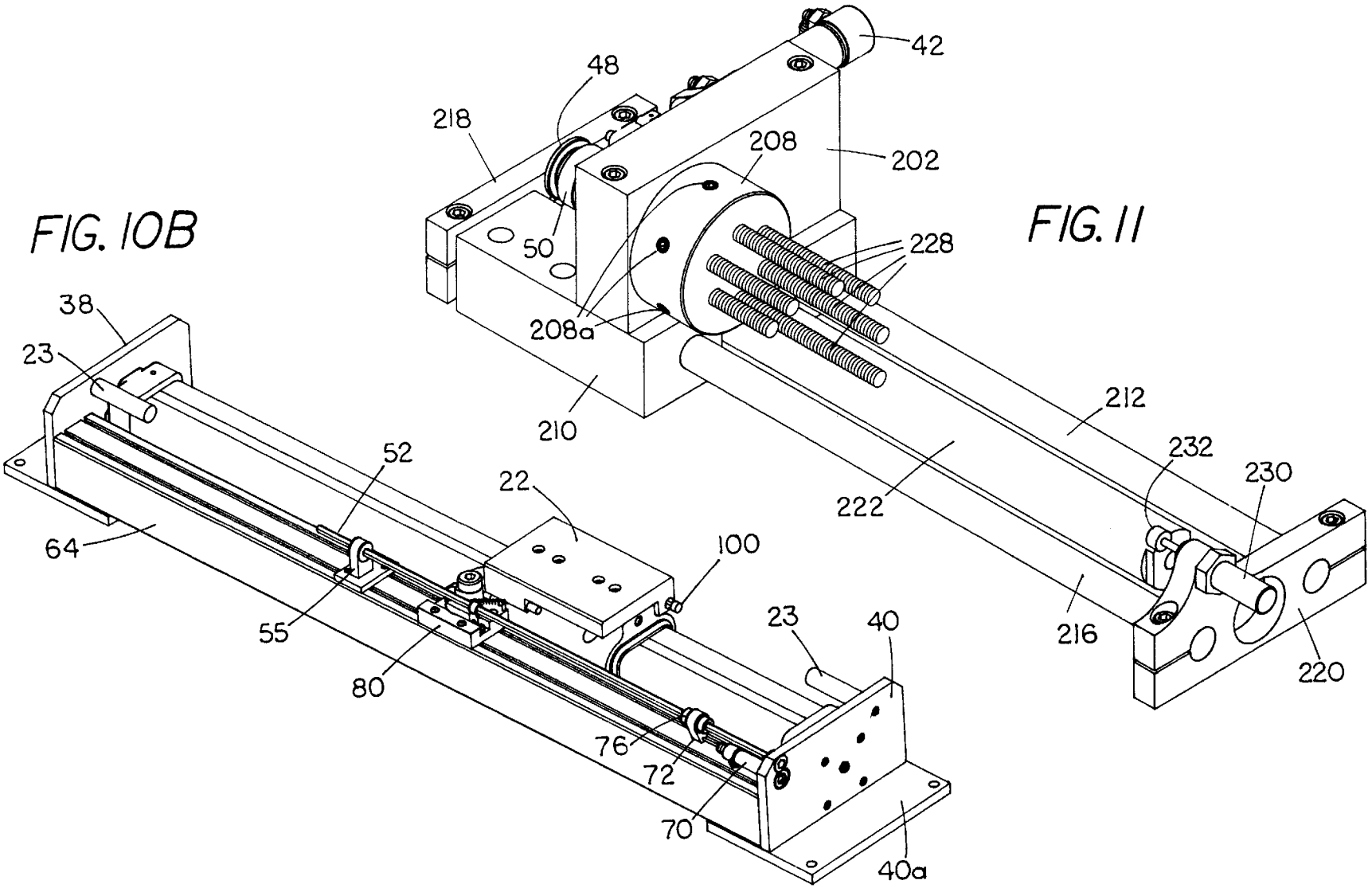

FIGS. 10–10B are perspective sequential views of the invention with only one stop block in use.

FIG. 11 is a front perspective view of another embodiment of the invention before the carriage has been moved to a selected position.

Figure 12:
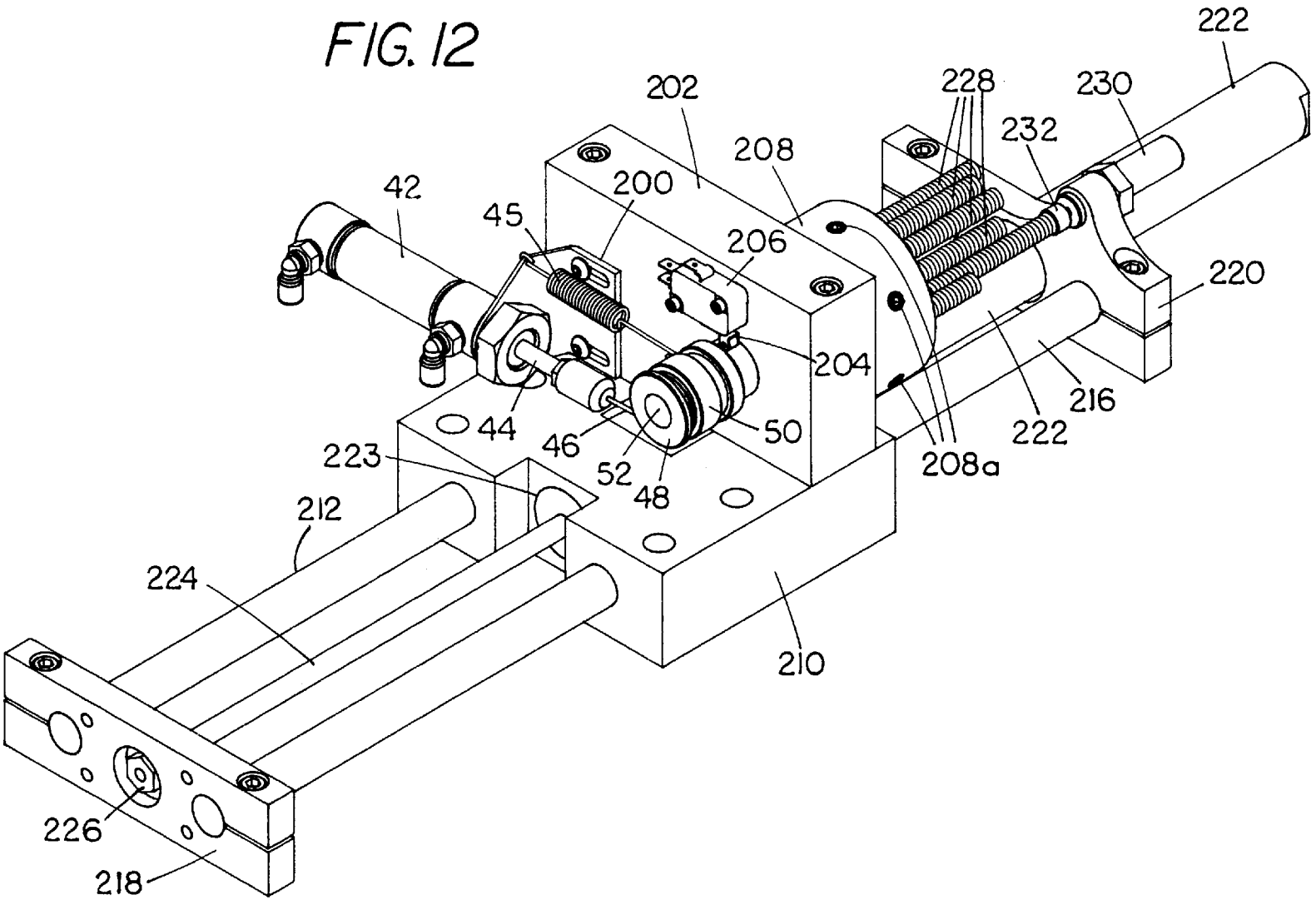

FIG. 12 is a rear perspective view of FIG. 11 with the carriage moved to a selected pre-set position.

Figure 13:
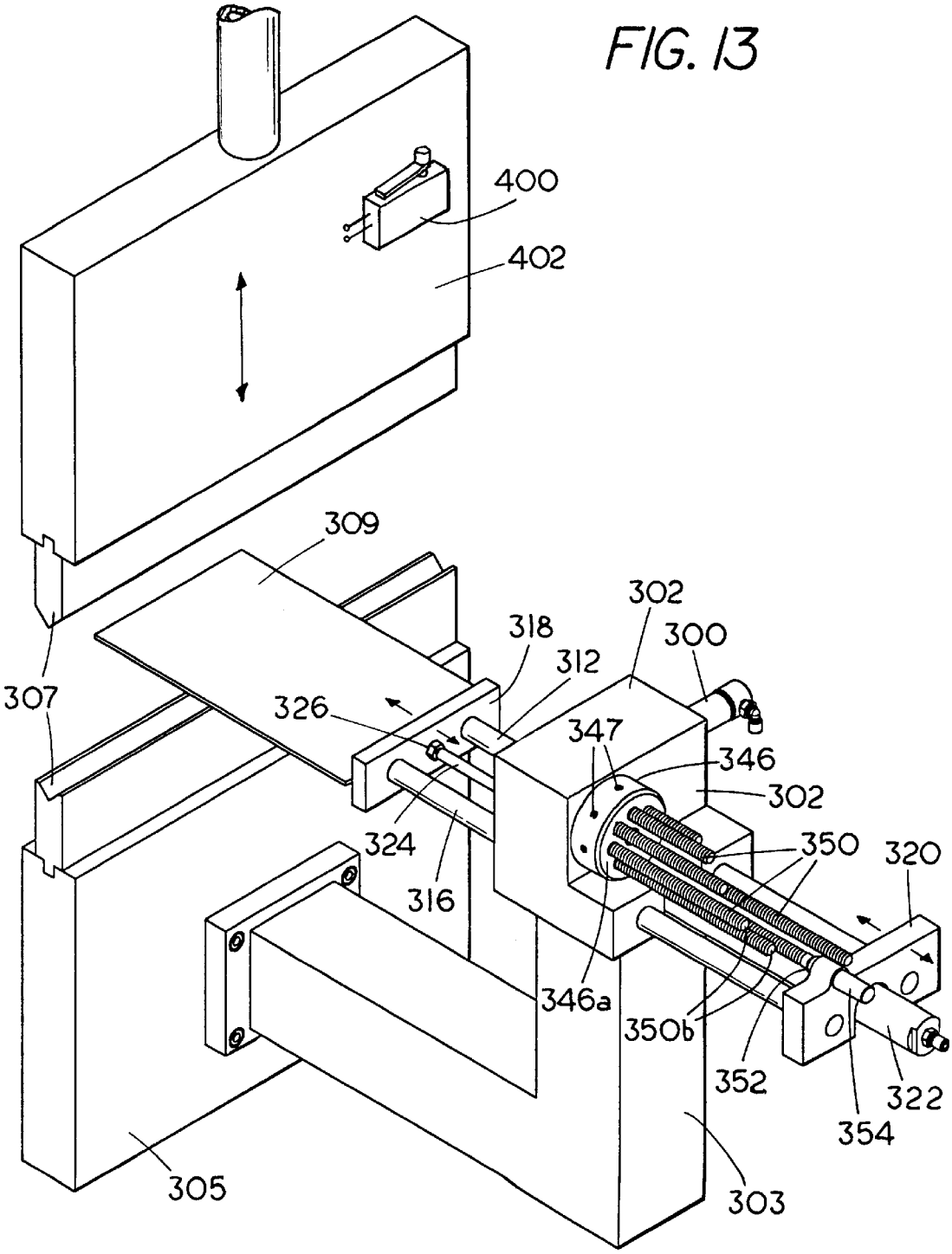

FIG. 13 is a rear perspective view of another embodiment of the invention that employs a rotating hub which supports one or more stop members.

Figure 14:
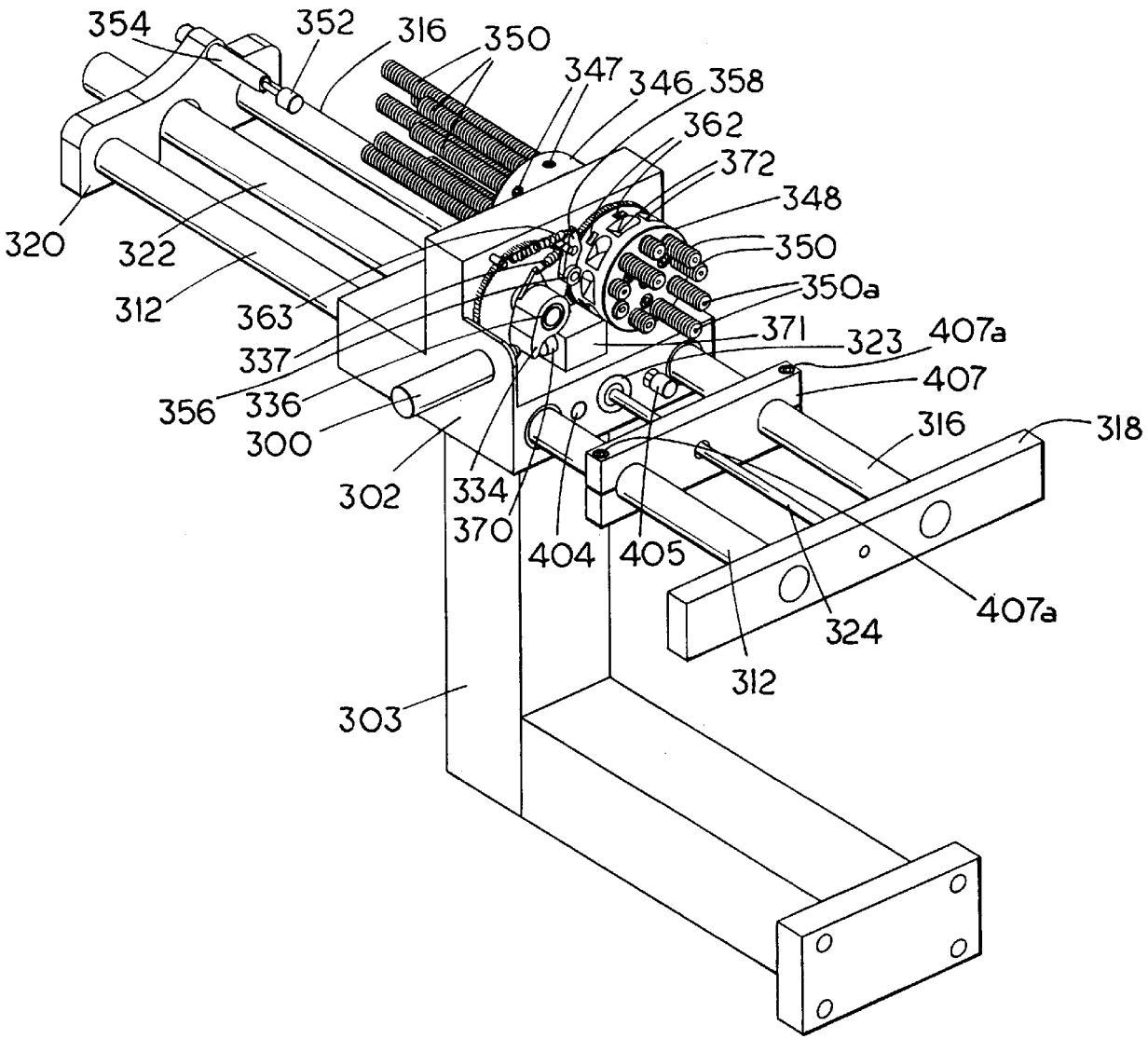

FIG. 14 is a front perspective view of the invention on a slightly larger scale than in FIG. 13, with a cover portion of the casing removed.

Figure 15:
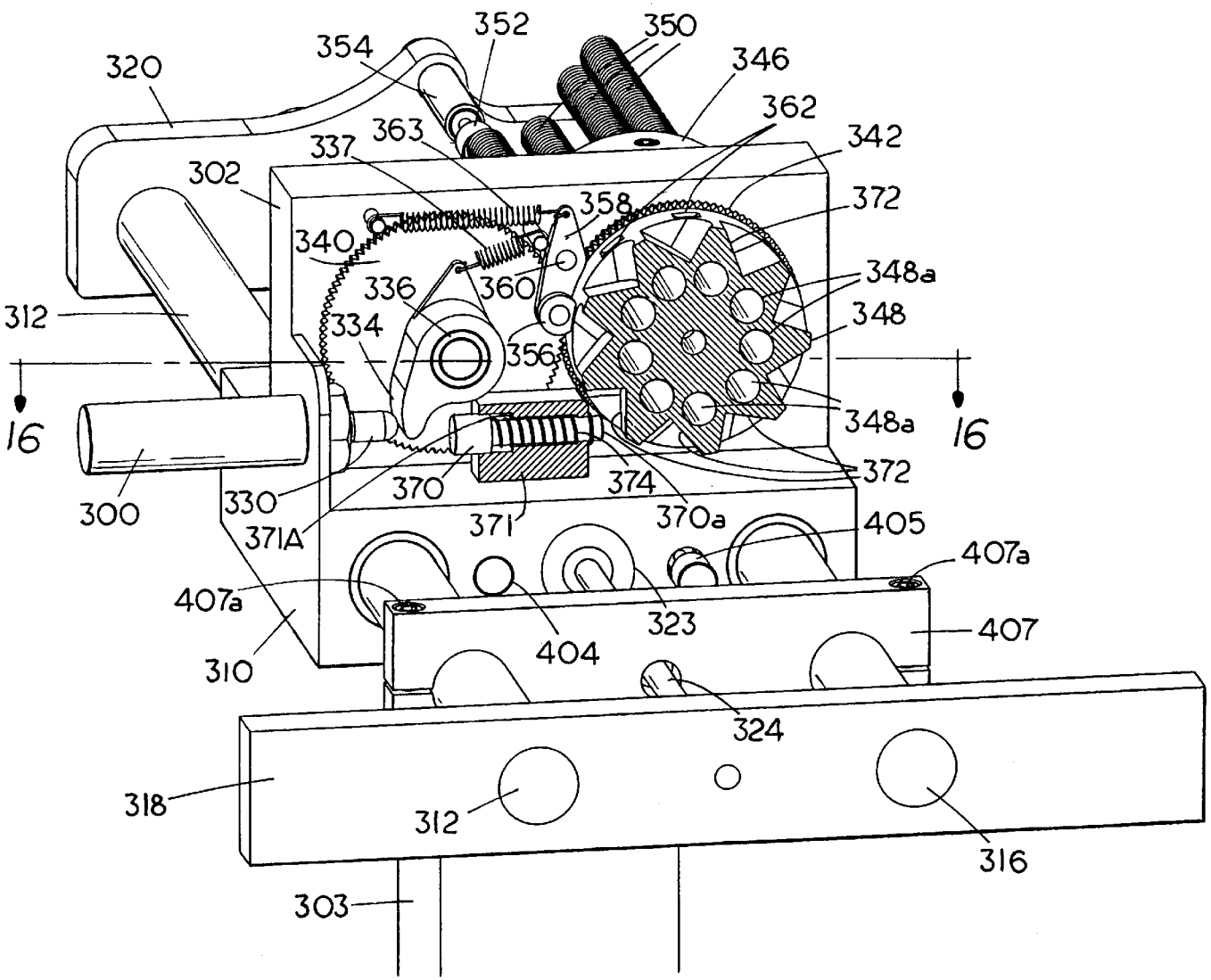

FIG. 15 is a front perspective view of the invention on a larger scale than in FIG. 14.

Figure 16:
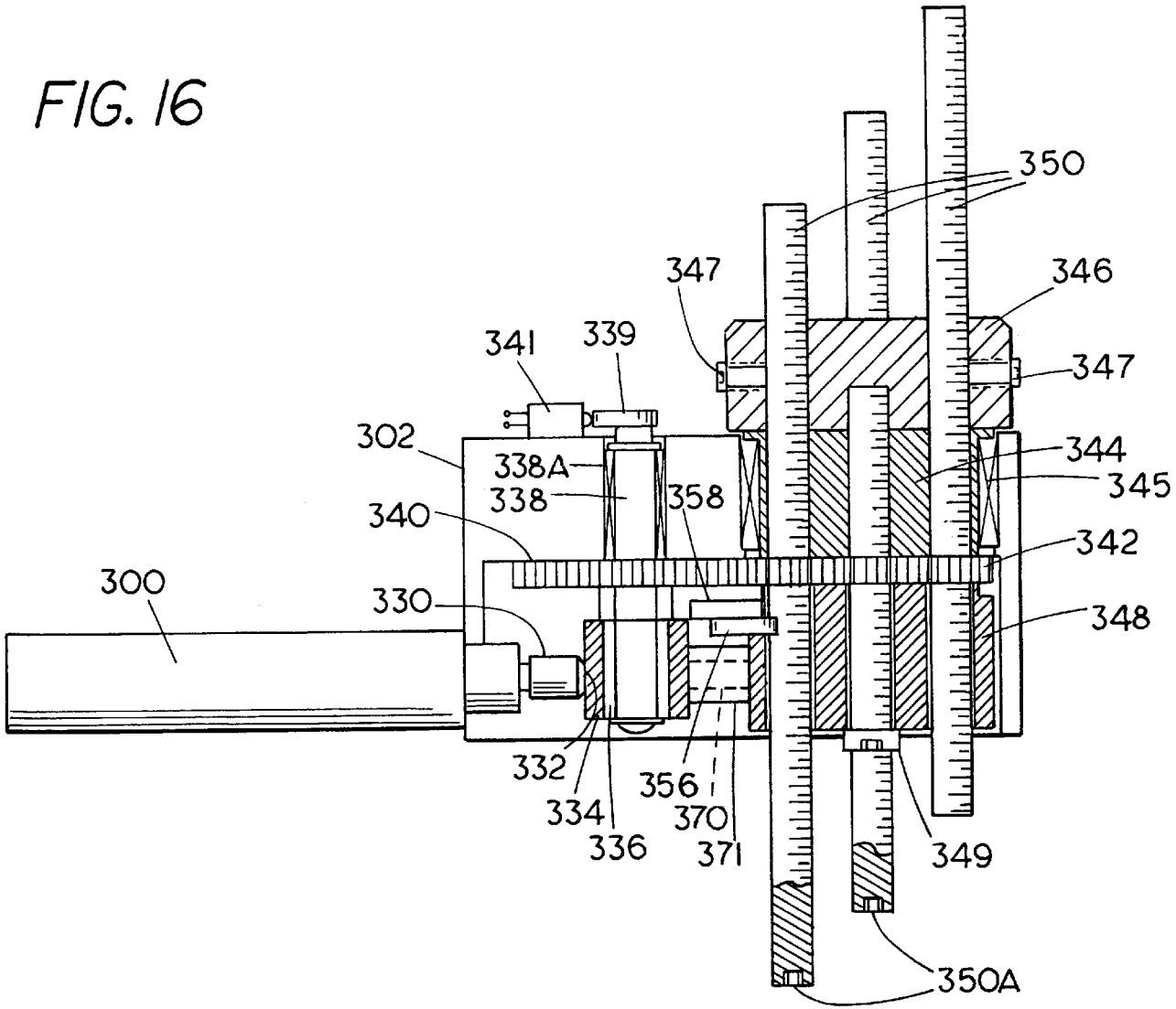
Figure 17:
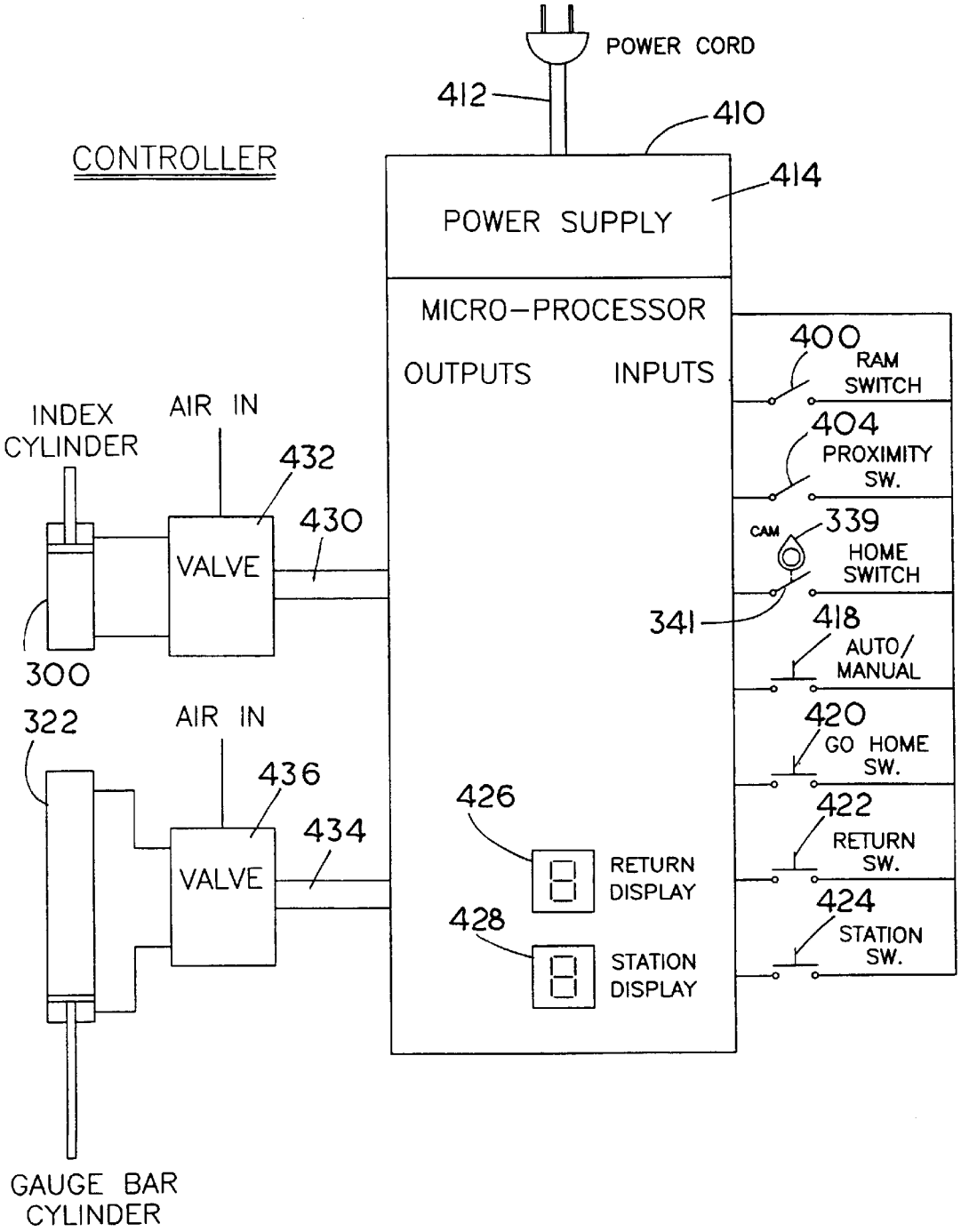

FIG. 16 is a horizontal sectional view taken on line 16—16 of FIG. 15, and FIG. 17 is a schematic diagram showing an optional form of controller for operating the invention when the operation is to be carried out automatically.

DETAILED DESCRIPTION OF THE INVENTION

Refer now to FIGS. 1–7 which illustrate a bi-directional positioning apparatus having a carriage or other machine element that can be located at selected positions while traveling in either direction.

Figure 1:
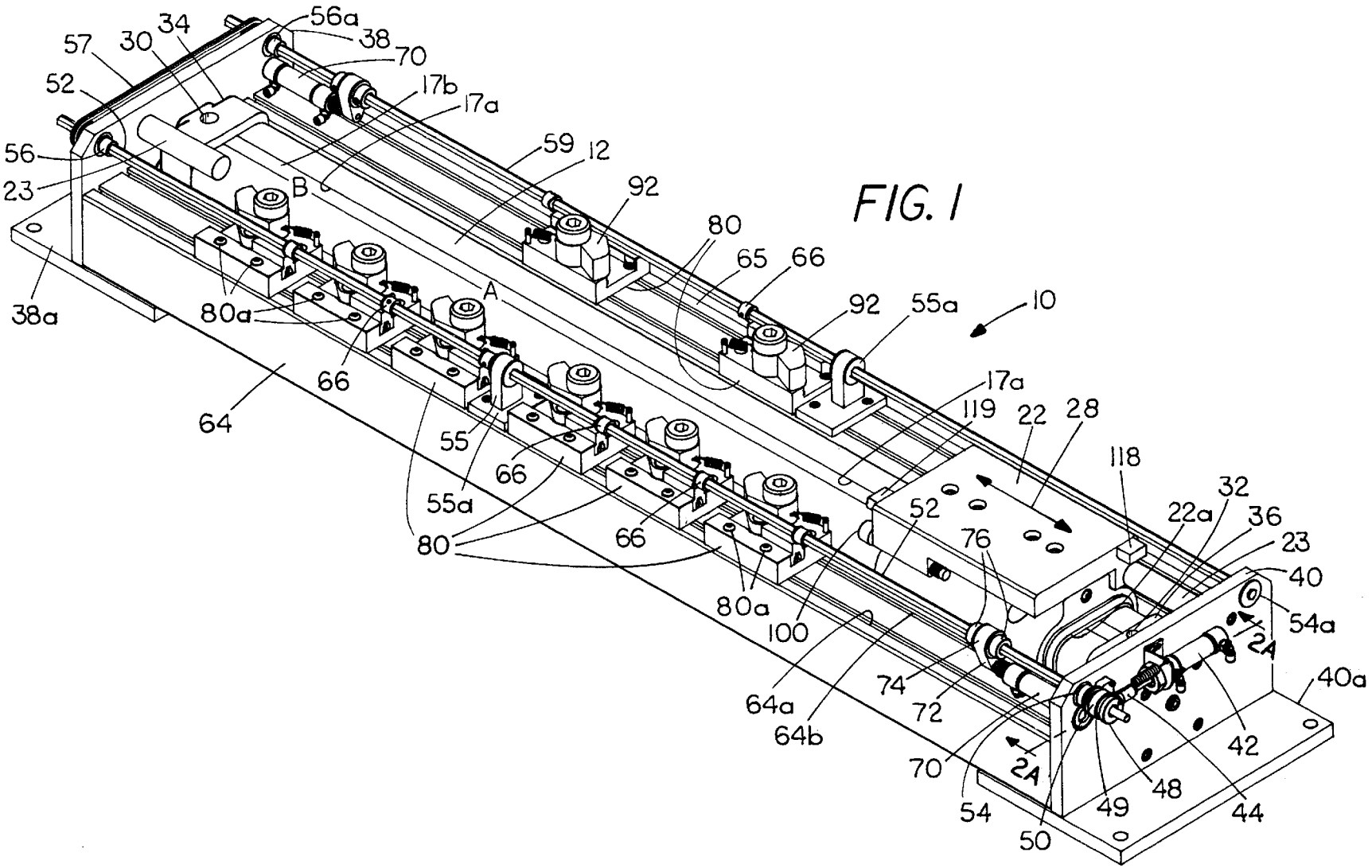
FIG. 1 is a perspective view of a preferred embodiment of the invention.
Figure 1A:
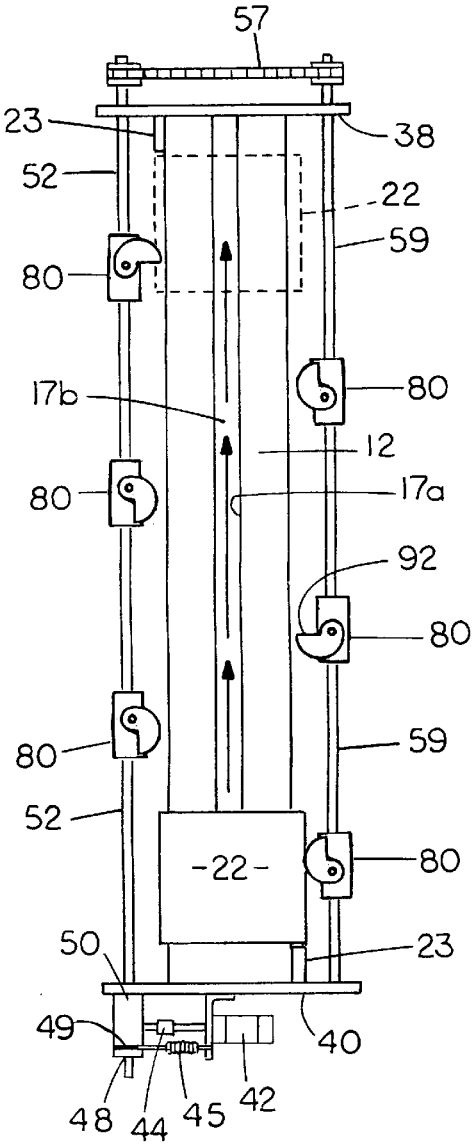
FIG. 1A is a diagrammatic plan view of the apparatus of FIG. 1.
Figure 2A:
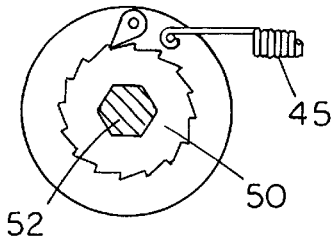
FIG. 2A is a vertical sectional view of the one-way clutch taken on line 2A—2A of FIG. 1.
Figure 2:
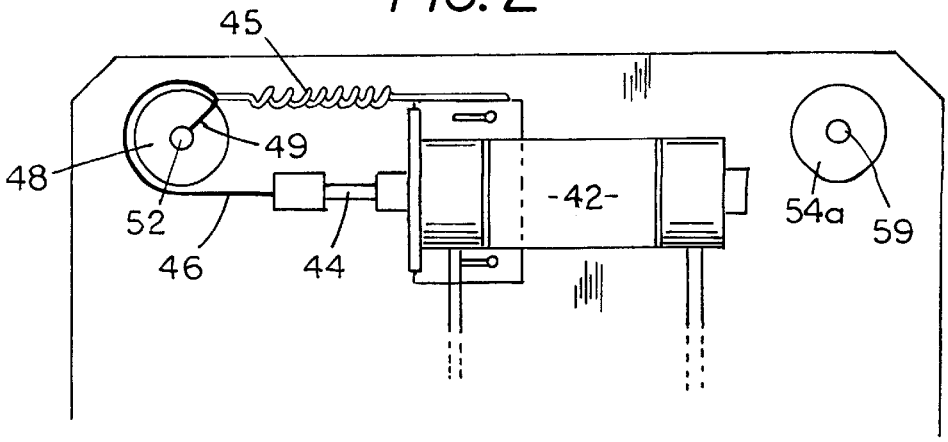
FIG. 2 is a right end elevational view of FIG. 1 on a larger scale.

Shown in FIGS. 1, 1A and 2 is a positive linear positioning apparatus 10 that can be used as a part of the present invention including an actuator assembly having a pneumatic band cylinder 12 that has a slot 17*a* or opening along the top which is sealed by means of a flexible sealing band 17*b*, e.g., a flexible plastic strip which seals the cylinder conventionally. Inside the cylinder 12 is a piston (not shown) that is connected to a sliding carriage or worktable 22 conventionally so that air can be held within the cylinder on both sides of the piston. Any suitable commercially available cylinder obtained from various manufacturers can be used in connection with the invention. The worktable 22 in turn is slidably mounted at 22*a* upon the cylinder 12 which enables it to slide longitudinally of the cylinder 12 along a rectilinear path or axis 28 responsive to air pressure changes on either side of the piston. Air is supplied to the cylinder 12 through air supply ports 30, 32 in cylinder heads 34 and 36, respectively. Thus, when the piston slides toward the right in the figure, the worktable 22 will also be carried to the right. It will be understood that the air pressure supplied through ports 30, 32 on opposite sides of the piston (not shown) will thus move the worktable 22 along axis 28 but by itself will be incapable of accurately locating the table at intermediate points and will thus provide only two terminal stop points, one located at each end of the cylinder 12 where the worktable 22 strikes the end of travel stops 23 at each end secured rigidly to the end plates 38 and 40, respectively. The carriage or worktable 22 can be further supported and stabilized by longitudinally extending, laterally spaced apart fixed guide rods (not shown) placed on each side of the pneumatic cylinder 12. The carriage 22 includes downwardly opening linear bearings that slide on the guide rods conventionally.

Mounting the worktable 22 on cylinder 12 provides a very compact structure. However, if desired, the invention can be applied just as well, in the alternative, to a worktable 22 secured to the end of a rigid connecting rod (not shown) that extends out of one end of the pneumatic cylinder 12. In such a case, the worktable 22 would not be positioned above the cylinder 12 as shown but instead would be at one end of the cylinder 12. The invention is applicable to either actuator type.

The selector mechanism used to provide multiple positioning of the worktable 22 will now be described with particular reference to FIGS. 1–5D.

Secured rigidly to the cylinder heads 34, 36, respectively, are a pair of end panels 38 and 40. To the outside of panel 40 is secured a stationary actuator assembly including an air cylinder 42 containing a movable piston (not shown) which is connected via connecting rod 44 to a cable 46 that is in turn wrapped around pulley 48 and secured at its end 49 to the pulley 48. The pulley 48 is in turn connected via one-way clutch 50 to an indexing shaft 52 (in this case hexagonal in cross-sectional shape) that is supported at its ends within bearings 54 and 56 in the panels 40 and 38 and by a centrally located bearing 55 carried on a support 55*a* secured to a fixed longitudinally extending frame member or support 64 comprising an extrusion that is rigidly fastened to panels 38*a* and 40*a,* e.g., by bolts (not shown). The frame member 64 can be an aluminum extrusion with two T-slots 64*a* and 64*b* formed in its upper surface. The hexagonal indexing shaft 52 is rotated repeatedly by means of the cylinder 42 in a series of indexing steps for selecting a stop point, each, by way of example, consisting of 60° steps to provide a total of 6 indexing steps to make one complete turn of the indexing shaft 52. The number of degrees traveled during each indexing step can be changed to suit the particular application in which the apparatus is used for the purpose of energizing a particular one of several stop assemblies 80 to be described below. Six steps of 60° serves as an example to illustrate a typical embodiment of the invention. The actuator cylinder 42 can be turned on and off manually, if desired, to index shaft 52 for selecting a stop point but is preferably operated by an automatic controller to be described.

Figure 4:
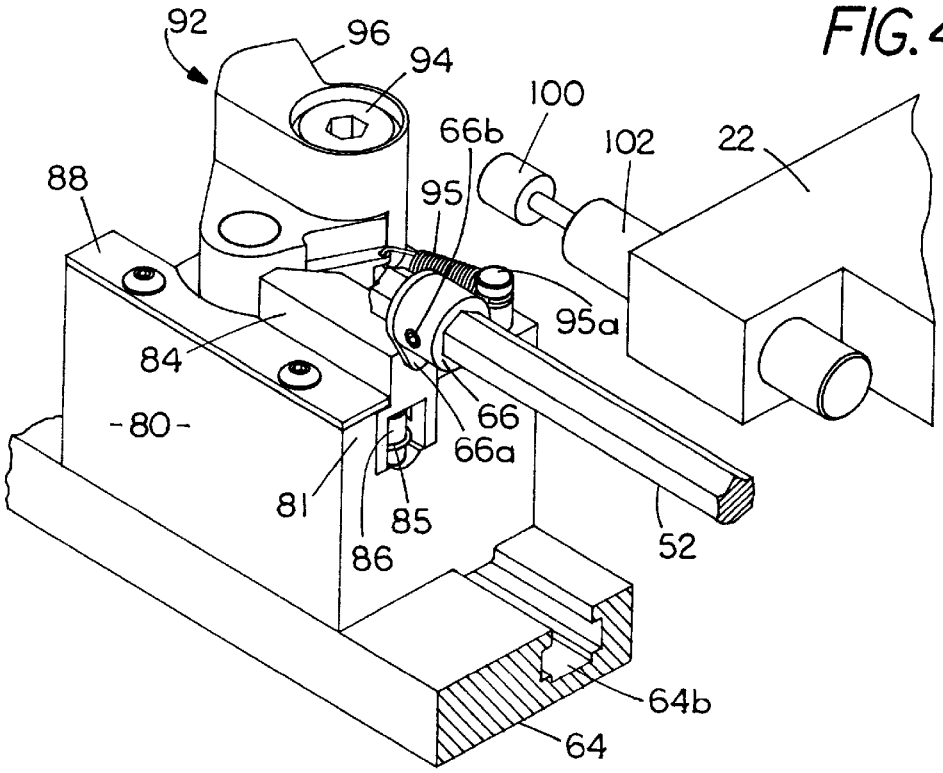
FIG. 4 is a perspective view of one of the stop assemblies as it appears just before the stop arm is moved to its extended position.

Distributed along the length of the indexing shaft 52 are six pressing sleeves 66, each having at least one pressing tab 66*a* (FIG. 4). Each of the pressing sleeves 66 is secured to the indexing shaft 52 by means of a set screw 66*b* such that the tab 66*a* of each sleeve extends in a different direction from the other tabs, so that in this case the tabs are spaced 60° apart circumferentially on the shaft 52.

The hexagonal indexing shaft 52 is slidably mounted for axial movement within its supporting bearings 54–56 so that it can be shifted axially during operation by means of a third pneumatic actuator comprising a cylinder 70 having an actuator connecting rod extending from its left end that is connected to a yoke 72, which is in turn secured at 74 between a pair of shaft collars 76 that are rigidly connected to shaft 52 for allowing rotation of shaft 52 while shifting the shaft 52 and sleeves 66 axially an appropriate distance, for example one inch, to the left in FIGS. 1 and 3–4A when the actuator 70 is extended toward the left.

At least one and possibly several identical stop assemblies or blocks 80 (FIG. 1) are provided. The stop blocks 80 are distributed axially in spaced apart selected locations along the length of the apparatus 10. Each stop block 80 is adjacent to and operatively associated with one of the pressing sleeves 66 and each stop block 80 is held in any selected manually adjustable position by means of screws 80*a* (FIG. 3A) which secure the stop blocks 80 within T-slots 64*a,* 64*b* of the stationary track or support member 64 that is itself rigidly connected to the end panels 38*a* and 40*a*. In a typical application of the invention for an automated robotic pick-and-place assembly operation or in any of a variety of factory automated robotic assembly or manufacturing applications, the stop blocks 80 enable the worktable 22 to be stopped at any of several selected precisely located stop points where work is to be performed or assembly steps are to be carried out. The position of each stop block 80 is infinitely variable because each block can be moved to and held at any point on the support member 64. To locate the worktable 22 at selected points, the operator slides the stop blocks 80 manually to the desired locations along the length of the support member 64 and then fastens each securely in place by means of the screws 80*a*. Each of the pressing sleeves 66 is then positioned accordingly at a point adjacent to the right end of one of the stop blocks 80 and is locked in place by its set screw 66*b*.

Figures 3, 3A:
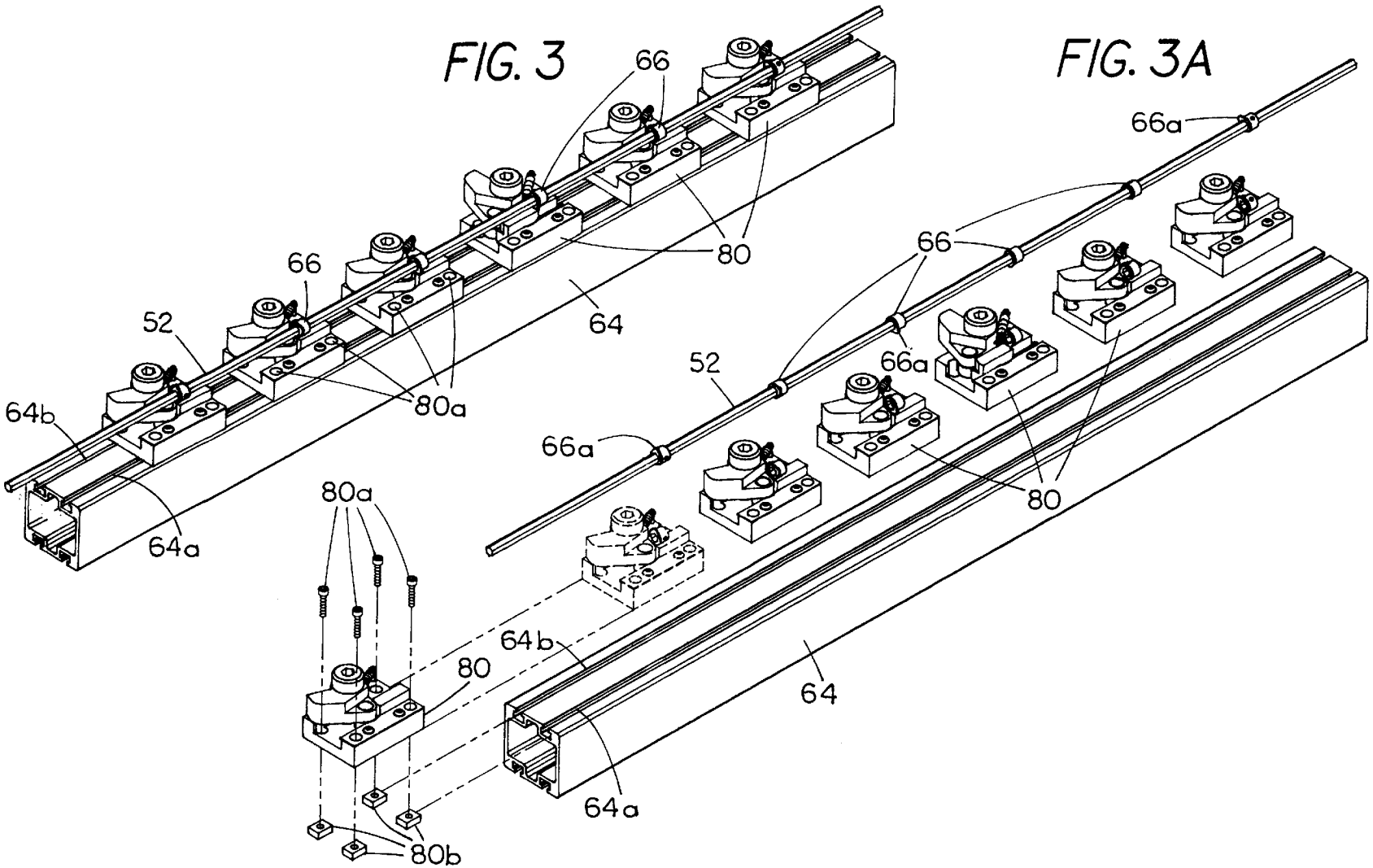
FIG. 3 is a diagrammatic view of six linearly arranged stop assemblies of FIG. 1 with the fourth stop assembly from the left in the operating or extended position.
FIG. 3A is an exploded view of FIG. 3.
Figure 4A:
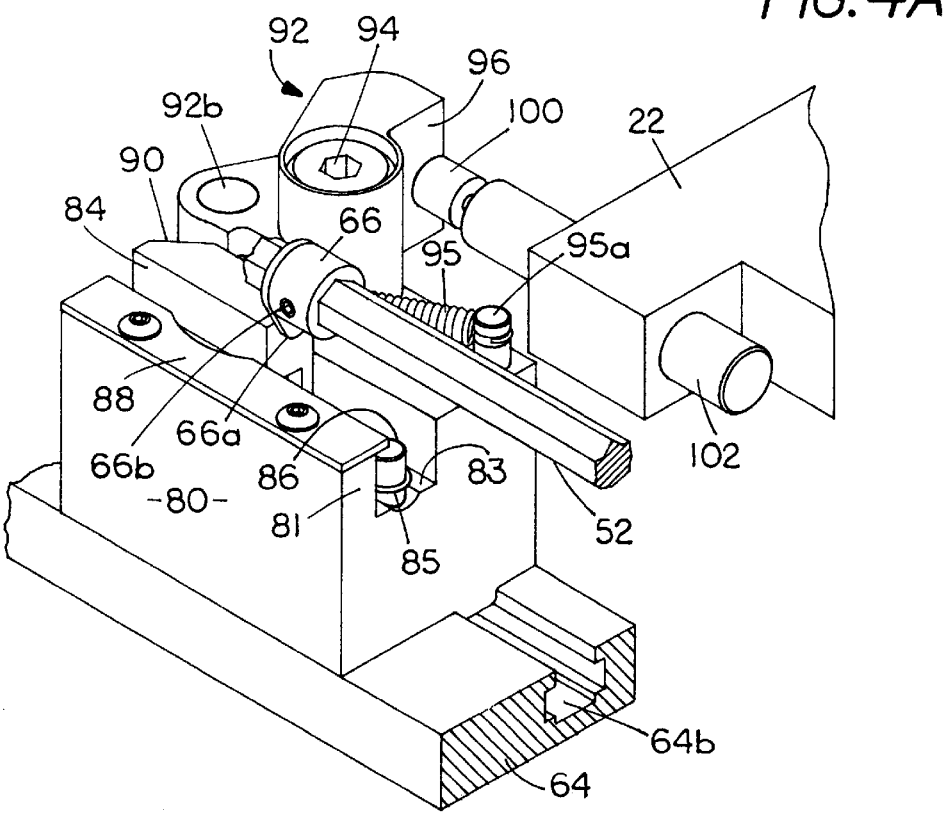
FIG. 4A is a perspective view of the stop assembly of FIG. 4 as it appears after the stop arm has been moved and locked in its extended position.

The construction of the stop blocks 80 will now be described with particular reference to FIGS. 4, 4A and 5A–5D. Each stop block 80 comprises a rectangular metal block having one or more downwardly extending flanges that extend into T-slots 64*a* and 64*b*. Each stop block 80 is secured to the support member 64 by fasteners such as the bolts 80*a* with nuts 80*b* located in the T-slots 64*a,* 64*b* as seen in FIG. 3A, thus allowing the stop blocks 80 to be positioned manually at any of an infinite number of locations. On top of stop block 80 is an upwardly facing, longitudinally extending slot 83 with a solid outer wall or abutment 81. Slidably supported in the slot 83 for longitudinal sliding action is a stop arm actuating and locking bar 84 which is urged toward the right in the figures by means of a helical return spring 85 (only a part of which is shown in FIG. 4A) attached to a pin 86 secured within the right end of slot 83. The bar 84 can be held in slot 83 by means of a retaining plate 88. The left end 90 of the locking bar 84 engages a roller 92*a* supported for rotation upon a pin 92*b* of a stop arm 92 which is itself mounted for pivotal movement upon a pivot pin 94 that is in turn affixed at its lower end, e.g., by means of screw threads, to the stop block 80. The stop arm 92 is normally retracted by being pivoted in a counter-clockwise direction to the position shown in FIG. 4 by means of a helical return spring 95 which is secured between the stop arm 92 and a pin 95*a* affixed to the stop block 80. In operation, the stop arm 92 has an operating face 96 that engages and stops the motion of the worktable 22 when the arm 92 is in the active mode, i.e., is extended to the operating position shown in FIG. 4A. Specifically, the operating face 96 of the stop arm 92, when extended by means of the locking bar 84, is located in the path of the worktable 22 to engage the bumper 100 of a shock absorber 102 which gently slows the movement of the worktable 22 until the extended bumper 100 reaches its seated position against the body of the shock absorber 102. It will be noted that in all embodiments of the invention the stop arm or stop lobe is retracted along a path leading away from the path of motion of the worktable. Consequently, the worktable does not have to be backed away from the stopped position for continuing movement in the same direction that it approached the stop assembly.

Figure 5A:
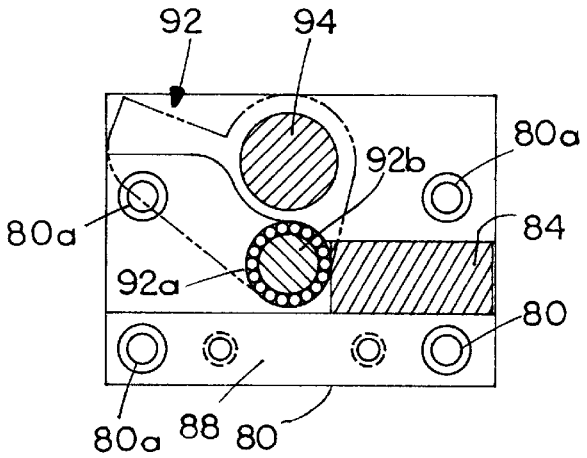
Figure 5B:
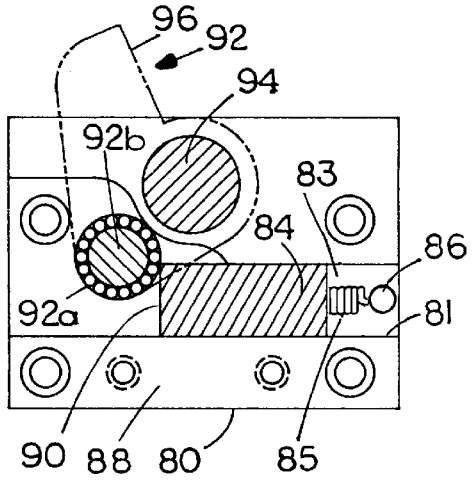
Figure 5C:
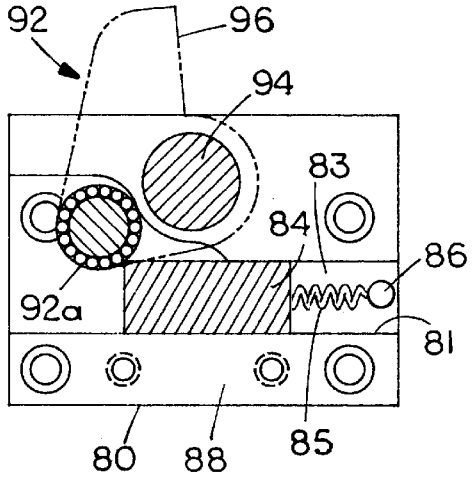
Figure 5D:
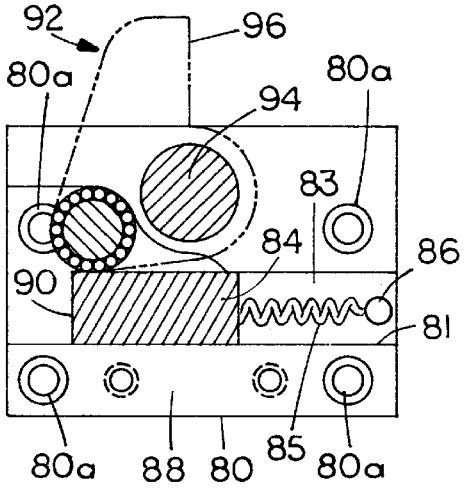

During operation, whichever one of the pressing sleeves 66 is selected to be used by rotation of shaft 52 is positioned with its operating tab 66*a* extending downwardly (FIG. 4A) into alignment with the locking bar 84 so as to engage and slide the locking bar 84 thus selected from right to left in FIGS. 4 and 4A as the actuator 70 shifts the indexing shaft 52 toward the left in the figures along its own axis, causing only the locking bar 84 of the selected stop block 80 to slide into engagement with the roller 92*a* of the corresponding stop arm 92, thereby pivoting only that stop arm 92 in a clockwise direction so as to extend that arm 92 to its operating position (FIG. 4A). The axial motion of indexing shaft 52 thus extends a selected one of the stop arms 92. Once the roller 92*a* has been moved to one side of locking bar 84 as shown in FIG. 5D, the continued motion of the locking bar 84 toward the left interposes the locking bar 84 bodily between the roller 92*a* and the wall 81 of slot 83. When this takes place, it can be seen that the locking bar 84 itself positively locks the stop arm 92 in place by wedging itself bodily between the roller 92*a* and the abutment formed by the wall 81 of the slot 83 so as to hold the stop arm 92 mechanically in the extended position.

It will be noted that the movable indexing shaft 52 extends between the linearly distributed stop assemblies 80 and is operatively associated with each of the stop assemblies 80. The shaft 52 functions as it is indexed repeatedly through a series of six indexing steps to make one complete turn of shaft 52 so as to sequentially place each successive stop arm 92 of each of the stop assemblies 80 in its operating or active mode. At a selected point, the rotational movement of the indexing shaft 52 is stopped so that only the selected stop arm 92 will be in the operating position. More specifically, the indexing shaft 52 rotates or indexes to align a particular pressing sleeve 66 with a stop assembly 80 at the selected stop point. The shaft 52 is then shifted along its own longitudinal axis by actuator 70 as described above to extend the selected stop arm 92 to its operating position.

Refer now to FIG. 6 which illustrates a homing mechanism for the indexing shaft 52 comprising a cam 110 secured, e.g., by means of welding or a set screw (not shown), to the indexing shaft 52. The cam 110 has a single slot 112 which is operatively associated with the arm of a microswitch 114 connected by means of conductors 116 to a controller 120 to be described below. The location of the worktable 22 is detected by two magnetic proximity switches 118 and 119 (FIGS. 1 and 7), one for each direction of travel, which are wired to a controller 120 to be described below.

Refer now to the controller 120 which will be described in more detail by reference to FIG. 7. The controller 120 can comprise any suitable electrical or electronic controller of suitable known construction, such as a Programmable Logic Controller (PLC). The PLC 120 is provided with inputs at the left that in many applications typically include a start switch 122, the homing switch 114 just described, and the proximity switches 118 and 119 mentioned above. PLC 120 is connected via conductors 130 to a pneumatic valve 132 that is coupled by air lines 134 and 136 to the cylinder heads 34, 36 of the cylinder 12. Conductors 138 are connected to pneumatic valve 140 that is coupled via air lines 142, 143 to opposite ends of the cylinder actuator 42. Conductors 144 are connected to an air valve 146 which are connected via air lines 148 to the opposite ends of the cylinder 70. The valves 132, 140 and 146 are supplied with compressed air from air tank 149 through lines 149*a*, 149*b* and 149*c* so that the cylinders 12, 42 and 70 are powered by a common energy source, in this case compressed air from tank 149.

The operation of the device will now be described. The apparatus is first turned on by means of the start switch 122 which begins the cycle. The home switch 114 sets the device to the start position shown in FIG. 1. The initial operation of the cylinder 12 will move the worktable 22 until it reaches "home" as detected by switch 118. When the cylinder 42 is indexed repeatedly, the indexing shaft 52 will rotate repeatedly through increments of 60° until switch 114 (FIGS. 6 and 7) closes, thus indicating the desired home position has been reached, whereupon the PLC 120 will stop the indexing rotation of indexing shaft 52.

Any suitable operating program for the PLC 120, which has been previously entered, can now begin. With reference to FIG. 1, assuming the stop points are numbered 1–8 from right to left with the stop blocks 80 comprising stop points numbered 2–7, the controller 120 can be set to lock the worktable 22 at selected points sequentially 1–6 or 8–1 or, if desired, at random points, e.g. 1, 6, 4, 3, 2, 5, etc. For example, assuming the worktable 22 is at the fourth position from the right at A and it is desired to move it two positions to the left at B, the actuator 42 is programmed to index twice, causing the indexing shaft 52 to index twice through an arc totaling 120° so as to locate the pressing sleeve 66 adjacent the stop block 80 at the left end of FIG. 1 (position B) in a downwardly extending position and immediately thereafter actuate the cylinder 70 once, thereby shifting the indexing shaft 52 toward the left so that the tab 66*a* adjacent the stop block 80 at B will then engage the corresponding locking bar 84 and force it toward the left thereby extending the stop arm 92 of the stop assembly 80 at the left in FIG. 1. The stop arm 92 of the stop block at A will be released to its retracted position as soon as the cylinder 70 retracts, thereby releasing the worktable 22 so that air pressure in the cylinder 12 is able to continue moving it toward the left in the figures into engagement with the extended stop arm 92 of the stop block at B. In this way, the worktable 22 can be moved without having to first back up, enabling it to move to stop points either in sequence or out of sequence to any of the points selected, i.e., in any desired order. Thus, the invention is well suited for multi-point positioning in a sequentially ascending order, e.g., positions 1, 2, 3, 4, 5, etc., but can also be used for random sequencing, e.g., positions 1, 7, 5, 2, 6, 3, etc.

In the embodiment shown in FIG. 1, there are six stop blocks 80 on the left side of the apparatus and two optional stop blocks 80 are provided on the right side, the latter being operated by means of an indexing shaft 59 (similar to shaft 52 already described) which is supported for rotation in bearings 54*a*, 55*a* and 56*a*. The stop blocks 80 on the side of the cylinder 12 closest to the observer stop the motion of the carriage 22 as it moves from right to left in the figure. It will be seen that the arms 92 of the stop blocks 80 on the other side of the apparatus face the left end of the cylinder 12 as seen in the figure for the purpose of stopping the motion of the carriage 22 as it moves from left to right.

The indexing shafts 52 and 59 are connected at their left ends in FIG. 1 with a chain and sprocket assembly 57 (or with a timing belt) to keep the shafts 52 and 59 synchronized with each other. On the other side of the cylinder 12 are provided any desired number of stop assemblies 80 positioned so that each stop arm 92 when extended faces the left in FIG. 1 (the top of FIG. 1A). Thus, during operation when the worktable 22 moves toward the top of FIG. 1A, any of the stop assemblies 80 on the left side are capable of stopping the movement of the table. At the end of the stroke of cylinder 12, when the worktable 22 reaches the dotted line position, its motion is reversed. During the reverse motion toward the bottom of the figure, any of the stop assemblies 80 on the right side of the figure can be used to stop the motion of the worktable 22 at the desired stop point through extension of the corresponding stop arm 92 as described above. The embodiment of FIGS. 1–5D is suited for handling relatively heavy loads, e.g. exerting a 400–500 pound force on the carriage or worktable 22, and is capable of locating it in any selected position with an accuracy of up to 0.001 inch. In larger size units, more than six stop assemblies 80 can be employed along the length of a hexagonal indexing shaft 52. In operation, the switches 118 and 119 confirm that the worktable 22 has been stopped at the selected stop assembly 80. When more than six stop assemblies are required for a specific application, a 60° indexing shaft can still be used. When the worktable 22 is moved from stop block position #6 to stop block position #7 (not shown in FIGS. 1–5), the stop block at position #7 will operate under the same conditions as stop block position #1, i.e. both of the stop arms 92 of positions #1 and #7 are extended. It makes no difference that the stop block 80 at position #1 has its stop arm 92 in the extended position, since the carriage 22 has already passed that point so that only the stop block at position #7 is active in stopping the carriage 22.

Refer now to FIGS. 8–9A which illustrate an alternative form of the invention in which the same numerals refer to corresponding parts already described. To show how various forms of actuators can be used, the invention will be described for use in conjunction with a pneumatic actuator 12 that is magnetically coupled to the carriage 22 in a manner well known to those skilled in the art, by the provision of aligned cooperating permanent magnets that are located within the carriage 22 and on the piston (not shown) of the actuator 12 to keep the carriage 22 coupled with the actuator piston. For convenience, this type of actuator is referred to as a "magnetically coupled actuator." Any suitable commercially available magnetically coupled actuator can be employed in connection with the invention. In this embodiment the pressing sleeves 66, locking bars 84 and pivoting stop arms 92 are not needed and have been eliminated. A different form of stop block is designated generally by numeral 180. Each of the stop blocks 180 has a stop plate 182 with a polygonal-shaped central opening 183 (in this case a hexagonal opening) which is slidably mounted on the hexagonal indexing shaft 52 and is supported for rotational movement within a recess 184 within the stop block 180 of just sufficient depth to allow each stop plate 182 to rotate freely but with virtually no axial motion so that the recess 184 which is closed by a cover 181 serves as a thrust bearing. Each stop block 180 is secured to the track 41 in any desired position by means of bolts 180*a* and 180*b* which are threaded into nuts (not shown) located within the T-slot 41*a*. A portion of the stop block 180 also extends into the adjacent slot 41*b* within the track 41 to provide additional support. Each opening 183 within the stop plate 182 corresponds in shape to that of shaft 52 so that the plate 182 will rotate with the latter. Each stop plate 182 is provided with a radially extending stop lobe 186 and each lobe 186 points in a different direction. In this case the lobes 182 are each spaced from adjacent lobes circumferentially by an angle of 60°. In FIG. 8A it can be seen that the stop members 182 are positioned on the shaft 52 with the lobes 186 located 60° apart. Each of the stop lobes 186 serves as a stop member or arm when extended toward the right as in FIG. 9 to an operating position directly in the path indicated by dotted line 188 aligned with the bumper 100 of the shock absorber 102 connected to worktable 22. The embodiment of FIGS. 8–9A is especially well suited for smaller bore cylinders which are used in lighter load positioning applications.

During operation, the indexing shaft 52 is indexed by being rotated as described above so as to position a selected one of the stop lobes 186 in an operating position extending toward the right and located on axis 188 so that when the cylinder 12 drives the worktable 22 toward the left in FIG. 9, the shock absorber 102 will decelerate the worktable 22 until the bumper 100 makes contact with the shock absorber 102, thereby stopping the worktable 22 precisely at the selected stop point. It can be seen that if the shaft 52 is rotated an additional 60° from the position shown in FIG. 8A, none of the stop lobes 186 will be in the extended position, and accordingly the carriage 22 will be free to travel throughout its full stroke without striking any of the stop blocks 180. It should also be noted that in this case there is no need to shift the indexing shaft 52 along its own axis and, consequently, the cylinder 70 and the associated structure for moving the shaft 52 axially can be eliminated. The vertical wall of the recess 184 and cover 181 engaging the parallel faces of the stop plate 182 serve as a positive mechanical element for retaining the stop plate 182 in its operating position when the lobe 186 strikes the shock absorber 102 of the worktable 22. The walls of the recess 184 and cover 181 act as a thrust bearing engaged with the parallel front and rear surfaces of the stop plate 182. The embodiment of FIG. 8 has the advantage of being simpler in construction since it requires fewer parts.

The embodiment of FIGS. 8–9A can be operated differently from that of FIGS. 1–7. In the embodiment of FIGS. 1–7, the stop blocks 80 can be operated so that all six of the stop arms 92 are initially retracted. Then, when the operating cylinder 70 is actuated so as to slide the shaft 52 axially, one of the stop arms 92, depending upon the rotational position of the shaft 52, will be extended. If none of the stop arms 92 are extended, the carriage 22 will slide all the way toward the left in the figure until it strikes the end stop 23 which determines the location of an eighth position. Then, if on the return trip (toward the right in FIG. 1) the carriage 22 is not stopped by one of the two stop arms 92 on the far side of the apparatus from the observer, it will travel all the way toward the right and strike the end position stop 23 at the right end of the apparatus which defines another position; position #1. However, the preferred operation of the embodiment of FIGS. 8–9A is somewhat different. In this case it is preferred to use five stop blocks 180 for a six-sided indexing shaft 52 so that there is a rotational position of shaft 52 in which there is no lobe 186 aligned with the bumper of the shock absorber 102. This position of shaft 52 allows the carriage 22 to travel freely all the way from one end of its stroke to the other. In any other rotational position of the shaft 52, the carriage 22 will come to rest adjacent a stop block 180 where the lobe 186 is extended as shown in the second stop block from the left in FIGS. 8 and 8A.

As noted above, the stop lobes 186 are spaced radially from one another at 60° increments but since only five are provided there is always one position of the shaft 52 in which none of the stop arms 182 are in an extended or active position, i.e. all are 'off' in one selected position of the shaft 52. This simplifies the control of the apparatus. It will also be understood that one less valve is needed since the shifting actuator 70 is not required. In with the embodiment of FIGS. 8–9A, like FIGS. 1–7, any number of stop blocks, e.g. 20 blocks, can be used if required. In that case, every seventh block becomes functional under the same conditions as stop block #1.

FIGS. 10–10B illustrate a uni-directional positioning unit in which most of the stop blocks 80 have been removed so that a single stop block 80 is employed for locating the carriage 22 at the position shown in FIG. 10B while traveling from right to left in the figure. When the stop arm 92 of the stop block 80 is in the retracted position, the carriage 22 is capable of moving past the stop block 80 the full length of its stroke, i.e. all the way toward the left in the figure, until it strikes the end of travel or end position stop 23. It will also be noted in FIGS. 10–10B that, since there is only one stop block 80, the shaft 52 does not need to be rotated to move it to a selected position. Accordingly, components 42–50 for rotating the shaft 52 are not needed and can be eliminated since no rotational indexing is required.

Refer now to FIGS. 11 and 12 which illustrate how the invention can be employed with a different form of stop member. The same numerals refer to corresponding parts already described.

In this case, the indexing or selecting actuator 42 is supported on a bracket 200 which is secured to a vertical plate member 202 that is attached rigidly, e.g. by bolts, to a fixed base 210. A pair of parallel, laterally spaced apart slide rods 212, 216 are slidably mounted on the base 210 and are secured rigidly at their ends to end plates 218, 220, either one of which comprises a moving carriage or worktable. Between the slide rods 212, 216 is an actuator assembly such as a pneumatic actuator 222 that has a moving actuator rod 224 which is bolted at 226 to the end plate 218. The casing of the actuator 222 is rigidly affixed at 223 to the base 210 so that the operation of the actuator 222 moves the end plates 218, 220 during operation toward the left or right. The one-way clutch 50 functions as already described to select a stop point by rotating the indexing shaft 52 through a succession of angular indexing steps of 60° each. In this case the shaft 52 is journaled for rotation in the plate 202. The shaft 52 has a cam 204 that extends radially from it in position to actuate a homing switch 206 similar to switch 114 already described. Connected to the shaft 52 is a hub 208 that is provided with six parallel, circumferentially spaced apart, selectively extensible stop members 228 each equidistant from the axis of the indexing shaft 52. Each of the stop members 228 is a threaded rod which is screw-threaded into one of six parallel, circumferentially distributed threaded holes that are separated from adjacent holes by an arc which is equal to the angle subtended by each index step produced by the actuator 42 and one-way clutch 50, in this case 60° each. The hub 208 can be provided with a plurality of set screws 208*a*, one for holding each of the stop members 228 in a manually selected position.

The end plate 218 or 220 can be connected to any kind of movable machine element, such as the head of a milling machine, drill press, lathe or can be used to mount any kind of end effector, e.g. a vacuum cup or pneumatic gripper to pick up and place a component or workpiece which requires positioning in a plurality of selected positions.

Prior to operation, the threaded stop members 228 are each selectively extended from hub 208 manually by screwing them in or out of the threaded holes within the hub 208. Thus, the stop members 228 are extended from the hub to any selected infinite number of possible positions to determine a selected stop point for that stop member. Each of the stop members 228 is then locked in place with one of the set screws 208*a*. Prior to energizing the actuator 222 to move the end plates 218 and 220 from their starting point as shown in FIG. 11, the actuator 42 of the indexing shaft 52 is operated any desired number of indexing steps so as to rotate the shaft 52 through a predetermined arc equal to the sum of the indexing steps. This will position a selected stop member 228 in alignment with a bumper 232 and shock absorber 230 that is mounted on end plate 220. Then, when the actuator 222 is energized, the end plates 218, 220 will travel from right to left in FIG. 11 until the selected stop member 228 strikes the bumper 232 of the shock absorber 230, thereby precisely holding the end plates 218, 220 in the desired position as shown in FIG. 12. It will be seen that each of the stop members 228 projects a different distance from the base 210 and hub 208 to thereby stop the rectilinear movement of the end plates 218, 220 at a different point, thereby positioning them in a plurality of different stop points, one after the other as each stop member 228 is selected. Because the stop members 228 can be threaded in or out of the hub 208 any desired distance, the selected positions taken by the end plates 218, 220 can be varied infinitely, thus enabling the end plates to be positioned precisely at any of an infinite number of positions. This form of the invention, while very precise, is not as well suited for long stroke applications or for achieving large numbers of positions because it is limited to the number of stop members 228 that can be placed on the hub 208.

Reference will now be made to the embodiment of FIGS. 13–17. Briefly, in accordance with this form of the invention, a linear positioning apparatus is provided for a positioning actuator assembly including a cylinder and movable piston to be used for moving a workpiece or worktable along a rectilinear path or thrust axis. The apparatus includes at least one stop member adjustably mounted on a support such as a plate or hub. To stop the worktable at a selected stop point, each stop member can be positioned to engage a bumper or other object to halt movement when the correct position has been reached. The apparatus includes means such as an actuator operatively associated to provide relative aligning movement between the stop member and bumper for placing the bumper and a selected one of the stop members in alignment with each other. The support for the stop member, e.g., a plate or hub, includes a bore or passage that extends entirely through it for each stop member so that each stop member can project out through both sides of the support. Consequently, the stop member can be fully retracted or extended its full length with respect to the support. For example, if the stop member is 20" long, it can be extended from 0" to 18" from one side of the support even if the support is only 2" in thickness, because it is able to project from both sides of the support and pass entirely through it.

Turn now to the figures, and particularly FIGS. 13–16. An indexing or selecting actuator 300 is supported on a framework or casing 302 that serves as a fixed base which is in turn supported by a bracket 303 on the foundation 305 of a machine with which the invention is to be used, in this case a press brake having upper and lower dies 307 for bending a sheet metal workpiece 309. A pair of parallel, laterally spaced apart slide rods 312 and 316 are slidably mounted on the fixed framework 302 and are secured rigidly at their ends to an end plate or gauge bar 318 and an end plate 320. In this case the gauge bar 318 acts as a moving carriage or worktable to which the workpiece 309 comes in contact. Between the slide rods 312, 316 is an actuator assembly comprising a main pneumatic cylinder actuator 322 that has a moving actuator rod 324 which is bolted at 326 to the gauge bar 318. A conventional piston (not shown) is located within actuator 322 on the opposite end of the rod 324. The casing of the actuator 322 is rigidly affixed at 323 (FIGS. 14 and 15) to the fixed framework 302 so the operation of the actuator 322 moves the end plates 318, 320 during use toward the left or right, e.g., for positioning or withdrawing the workpiece 309, or in other applications for the placement of parts, e.g., in factory automation for the placement of components during the assembly of electronic equipment. Thus, the invention can be used in various applications including pick-and-place operations as well as use as a back gauge for a press brake or shear.

As shown in FIGS. 14 and 15, the indexing actuator 300, which is similar to the actuator 42 of FIG. 12, has an extendable actuator rod 330 with a free end 332 that can be extended to contact an arm 334 of a one-way clutch 336 mounted on a shaft 338 that is in turn journaled for rotation at 338*a* (FIG. 16) in the casing 302. The arm 334 of the one-way clutch 336 is yieldably biased in a clockwise direction so that the arm 334 is forced against the free end 332 of the actuator rod 330 by means of a spring 337. Keyed to the shaft 338 is a drive gear 340 that is in turn engaged with a driven gear 342 which is connected rigidly to a rotatable shaft or turret 344, a stop member support comprising a rotating hub 346, and a detent hub 348, all of which are coaxial with driven gear 342. While gears have been used for driving the hubs, they could be replaced for some applications by other drives such as timing belts or a chain-and-sprocket assembly, if desired. The hub 346 and detent hub 348 all rotate as a unit and are supported by the turret 344 which is journaled for rotation within a bearing 345 in the casing 302. The hub 346, the turret 344 and the detent hub 348 are also provided with aligned axially extending, circumferentially distributed openings or bores 348a (FIG. 15) for one or more stop members 350 which are aligned with the thrust axis of the main actuator cylinder 322 and turret 344.

It will be noted that the stop members 350 extend entirely through the hubs 346, 348 and the turret 344 and can project out through both the front and rear faces so that each stop member can be retracted or extended its full length from the hub 346. The openings in the hub 346 are threaded and the stop members 350 are screw-threaded therein. However, the bored openings 348*a* within the turret 344 and hub 348 for the stop members 350 are slightly larger in diameter than the stop members so that the stop members 350 can slide easily through the turret 344 and detent hub 348. The detent hub 348, turret 344 and hub 346 are keyed together and are secured to one another by means of one or more fasteners such as a screw 349 (FIG. 16). Simply by removing the screw 349, the hub 346 can be quickly disconnected, taken off and replaced by another hub to be used for performing a different job and placed in storage until it is again needed, with all of the pre-set positions of the stop members preserved for future use. Because the stop members 350 project entirely through the hub 346, turret 344 and detent hub 348, they can be extended or retracted their entire length, thus allowing for large stroke changes, e.g., from 0" to 20" or more. Although the stop members 350 can for some purposes have smooth surfaces, they are preferably threaded and provided with screwdriver slots or hex openings for an Allen wrench as shown at 350*a* (FIGS. 14 and 16). Consequently, the embodiment of FIGS. 13–16 allows the stop members 350 to extend all the way through the support on which they are mounted, thereby providing infinite adjustment throughout their entire length. Since the Allen wrench openings 350*a* are on the front side of the machine closest to the workpiece 309, they are highly accessible, allowing the operator to easily adjust the stop members 350 by screwing them in or out to determine the various stop points of the gauge bar 318. After the operator has positioned each of the stop members 350 by screwing them in or out through the hub 346, they are locked in position by means of set screws 347.

Clean Version

The hub 346 and turret 344 are indexed during operation to the proper position to align a selected stop member 350 with an object for convenience referred to as a bumper 352 which halts the movement of the actuator 322. Thus, when one of the stop members 350 strikes the bumper 352 of a shock absorber 354 which is rigidly mounted on the end plate 320, movement of the moveable carriage or worktable defined by gauge bar 318 is stopped at the selected stop point.

A detent wheel 356 is mounted for rotation on a detent lever 358 which is in turn pivotally supported at 360 in the casing 302 and is urged toward the right in FIGS. 14 and 15 by means of a tension spring 363 so as to force the detent wheel 356 into any one of a plurality of circumferentially distributed detent slots 362 in the detent hub 348. Although the detent wheel 356 is capable of reliably holding the detent hub 348 and hub 346 in the selected index position, when the assembly 344, 346, 348 rotates rapidly, inertia could carry it beyond the detent. To prevent this, an anti-overrun pin 370 is slidably mounted within a stationary sleeve 371 and is yieldably biased toward the left in the figures by means of a compression spring 374. The left end of the pin 370 is in alignment with the lower end of the arm 334 so that when the rod 330 extends, it thereby turns the one-way clutch 336 in a counter-clockwise direction. After rotating about half-way of its full travel, the free end of the arm 334 strikes the pin 370 causing its right end 370*a* (FIG. 15) to engage any one of the plurality of circumferentially spaced apart ratchet-like notches 372 in the detent hub 348, thereby positively preventing the hubs 346, 348 and turret 344 from overshooting a selected position in which one of the stop members 350 is aligned with the bumper 352. Thus, during operation, after the arm 334 has rotated about half of its travel, it impacts the pin 370 forcing it to the right into one of the notches 372.

The invention can be operated either manually through the use of electrical switches or valves, if desired, or by means of a programmable logic circuit (PLC) of suitable known commercially available construction. The PLC can be programmed to extend the actuator 300 for indexing the hubs 346, 348 and turret 344 a predetermined number of times, with each index subtending, say, 45 degrees so that a selected sequence of stop members 350 are placed in alignment with the bumper 352 in the proper order for carrying out the particular machine operation.

The invention is especially, but not exclusively, useful for pneumatic actuator units known as "rod cylinders" or "Thrusters" which, without the invention, provide only a fully retracted or a fully extended position without the mid-stroke positioning that is made possible by the present invention. The positioning of a workpiece made possible by the apparatus of FIGS. 13–17 is especially suitable for two industrial uses; first, the mid-stop positioning for factory automation using air cylinders or actuators known as "linear slides," "rod cylinder slides," or "thrusters" and second, for use as a back gauge, i.e., a positioning device for a shear or press brake to control the cutoff length or the position of a bend in a metal plate. Besides being versatile, the simplicity of the invention makes it much less expensive than a ball screw or servo device. Moreover, each of the stop positions can be easily set at an infinite number of points by screwing the stop members 350 in or out of the hub 346. Laboratory tests have shown the invention is capable of operating repeatedly over a period of several months while maintaining accuracies as fine as 0.001 inch.

During operation, the form of the invention shown in FIGS. 13–16 is capable of repeatedly indexing the gears 340 and 342 and the hubs 346, 348 in 100 milliseconds or less. Thus, to move through four index steps of 45 degrees each requires less than 400 milliseconds, yet the inertia of the hubs 346, 348 will not cause an overrun due to the action of the anti-overrun pin 370.

In operation, the indexing actuator 300 performs two functions simultaneously. First, it drives the one-way clutch 336 which indexes the gears 340, 342 as well as the turret 344 and hubs 346, 348 one or more increment of, say, 45 degrees. Second, it extends the anti-overrun pin 370 into one of the notches 372 so that the hub cannot rotate beyond a desired position. The anti-overrun pin 370 bottoms on a shoulder 372*a* (FIG. 15) within the sleeve 372 so that its final position can be repeated precisely. As soon as the actuator rod 330 reaches its extended position, it and the pin 370 are immediately retracted in less than 100 milliseconds, at which point only the detent wheel 356 holds the hub and turret 344 in the proper position.

If a PLC is used to control operation it can be set for either manual or automatic mode. In one factory operation, for example, the invention can be set to perform a single bend repeatedly or, if desired, to repeat two bends at two different positions and to alternate between these two positions indefinitely. When operated in an automatic operation mode, the invention is especially valuable for use as a back gauge in bending or shearing metal plate. To perform, say, a one-inch bend and two three-inch bends in the auto mode, the operator can adjust two of the stop members 350 to extend three inches from the hub 346 and one stop member 350 to extend one inch from the hub 346. Thus, one can establish the position of any one of several bends then index back to a "home position" to then repeat the operation.

When the invention is used as a back gauge for a press brake, a ram switch 400 can be placed on the ram 402 supporting the movable die 307. Thus, the movement of the ram 402 to the fully raised or retracted position will actuate the switch 400 for commanding the gauge bar 318 to retract fully to allow indexing for the hub 346. A proximity switch 404 (FIG. 15) which functions as a gauge bar return switch can be mounted on casing 302 to confirm that the gauge bar 318 has been retracted, i.e., moved fully to the left in FIGS. 14 and 15, thereby allowing the hub 346 to index to the next station. It should be understood that while places for nine stop members 350 are shown in FIG. 15, the PLC can be set to return the hub 346 to the home position or station #1 after, for example, only two, three or four bends have been completed.

Refer now to FIG. 17 which illustrates by way of example one optional form of automatic control for operating the apparatus when automatic operation is to be carried out. It should be understood, however, that the apparatus can be operated manually by using manual pneumatic valves for controlling the indexing actuator 300 and the thrust actuator 322 if desired. FIG. 17 shows a programmable microprocessor 410 having seven inputs and two outputs of any suitable commercially available variety. Current is supplied by a power supply 414 and power cord 412. The first input is provided by the ram switch 400 (also shown in FIG. 13) which is actuated when the ram 402 is raised to its uppermost position for signaling the microprocessor 410 that the upper die 307 is out of the way. Numeral 404 designates the proximity switch located on a side of the casing 302 (FIGS. 14 and 15). This can either be actuated by the gauge bar 318 itself or, if desired, by an optional triggering bar 407 that is slid to the desired position on rods 312 and clamped onto the rods 312, 316 by means of screws 407*a* for energizing the proximity switch 404 when the bar 318 has been retracted any desired distance. The triggering bar 407 makes it possible to avoid having to withdraw the gauge bar 318 a full stroke between each incremental movement of the hub 346 and is especially useful when a series of short strokes are being made. A home switch 341 is operated by means of a cans 339 (see also FIG. 16) to indicate when the drive gear 340, driven gear 342 and hub 346 have reached the home position to initiate a new cycle. A switch 418 is provided for selecting either auto or manual operation. In manual operation, a switch 420 is used to cause the indexing actuator 300 to advance the gear 340 the required number of incremental steps needed to bring the device to the home position as reported by the position of the cam 339 and switch 341. A return switch 422 is used by the operator to program the device for the number of operations that the operator wishes to perform, e.g., four operations for four bends in a piece of sheet metal. The return switch 422 is pressed by the operator until the return display 426 shows the number '4' in that case. A station switch 424 is used in the manual mode. By pressing the station switch 424 once, the operator can energize the indexing actuator 300 once to advance the hub 346 to the next station. Repeated closing of the switch 424 will continue to index the actuator once each time the switch is operated, thereby advancing or indexing the hub 346 a selected number of incremental steps. Conductors 430 are wired to actuate a solenoid-operated valve 432 for indexing actuator 300, and conductors 434 are wired to actuate a solenoid-operated valve 436 connected to cylinder 322.

During operation the operator will first select auto or manual mode by operating the switch 418. The operation will now be described by way of example for use with a press brake. In the automatic mode, when the ram 402 of the press brake returns to the up position, the ram switch 400 is actuated, allowing the gauge bar 318 to retract fully so that indexing can be accomplished by the indexing actuator 300. When the gauge bar 318 is fully retracted, the proximity switch will be actuated. However, if the triggering bar 407 is in use, the triggering bar 407 itself will actuate the proximity switch 404, causing the thrust cylinder 322 to stop. A shock absorber 405 (FIG. 15) is provided on the framework 302 to assist in halting the movement of the gauge bar 318. Once the proximity switch 404 is actuated, the indexing actuator 300 operates so as to advance the hub 346 one increment to its next rotational position or station. In the manual mode, however, the operator can advance the indexing actuator 300 and turret 344 and hub 346 to the next station by depressing the station switch 424. This allows the operator to make as many bends as needed of a particular dimension. The station display 428 indicates which station is in position, i.e., which stop member 350 is aligned with the bumper 352.

If the hub 346 had, for example, nine stop members 350, the invention could produce a part with up to nine different bends in the automatic mode. However, if the part being made has, say, only four bends, the operator can depress the return switch 422 until the return display 426 indicates the number '4' to cause the indexing actuator 300 to return to the home position, i.e., station #1 after four bends have been completed. The cam-operated home switch 341 confirms that the turret 344 and hub 346 have returned to the home position. Alternatively, however, the operator can return the turret 344 and hub 346 by depressing the "Go Home" switch 420. The microprocessor 410 can be programmed to then extend the indexing actuator 300 the proper number of times required to advance the turret 344 and hub 346 to the home position.

The invention shown in FIGS. 13–16, with or without the controller of FIG. 17, is highly efficient in operation and the entire length of each stop member 350 can be used to determine a stop point since they extend entirely through their support. Moreover, the hub 346 can be removed for storage quickly until needed for re-use by removing a single fastener 349, and the pre-set positions of all the stop members 350 can in that way be preserved for future use. In addition, the device can easily be adjusted from the front of the machine adjacent the worktable, which provides excellent accessibility, by using screw slots or the Allen wrench openings 350*a* (FIG. 14) During operation, the apparatus can index through each increment in less than 100 milliseconds, and yet the anti-overrun means will reliably prevent the hub 346 from advancing too far. Furthermore, the invention is capable of operating with either a long stroke between each cycle of the cylinder 322 or, if desired, with a short stroke through the use of the triggering bar 407 which can be clamped onto the rods 312, 316 fairly close to the framework 302 for a series of bends or other operations that are close together, say, only two or three inches apart.

Many variations of the present invention within the scope of the appended claims will be apparent to those skilled in the art once the principles described herein are understood.

What is claimed is:

1. A linear positioning apparatus, comprising:

a positioning actuator assembly including a cylinder and movable piston to be used for moving a workpiece along a rectilinear or thrust axis, a support for at least one stop member, at least one stop member adjustably mounted on the support, a bumper mounted on the apparatus for stopping the workpiece, drive means operatively associated between the stop member and the bumper for placing the bumper and a selected one of the stop members in alignment with each other, the support for the stop member includes a passage that extends entirely therethrough such that the stop member can project out of both sides of the support, whereby the stop member can be fully retracted or extended substantially its full length from the support in either of two directions through said passage.

2. The apparatus of claim 1 wherein the stop member support comprises a hub mounted for rotation on the apparatus and said drive means includes indexing means for rotating the hub stepwise for aligning selected stop members sequentially with the bumper to control the stop position of the positioning actuator.

3. The apparatus of claim 2 wherein the indexing means is connected to a drive gear engaged with a driven gear secured to the hub for imparting rotation to the hub.

4. The apparatus of claim 1 wherein the support is a rotatable hub and a detent is operatively connected to the hub for locating the hub in selected circumferentially spaced apart positions about a central axis thereof.

5. The apparatus of claim 4 wherein an anti-overrun member is operatively associated with the apparatus for halting the motion of the hub when the hub is in a selected position.

6. The apparatus of claim 2 wherein the indexing means is an actuator connected to a drive member through a one-way clutch, and the drive member is connected for imparting rotation to the hub.

7. The apparatus of claim 1 wherein each such stop members is screw threaded in its support.

8. A linear actuator stopping and positioning apparatus for an actuator assembly that has a cylinder and piston operatively associated with a worktable for moving the worktable along a rectilinear path, said apparatus comprising:

an indexing actuator, a supporting hub rotatably mounted on the apparatus, said indexing actuator being operatively associated through a one-way clutch with the hub for imparting step-wise rotation thereto, one or more stop members supported by the hub, said stop members being adjustable on the hub for being extended and held at selected distances from the hub, and a bumper mounted on the apparatus for engaging one of the stop members to stop the worktable at a selected stop point that is selected through the step-wise rotation of the hub.

9. The apparatus of claim 8 wherein the stop members are mounted within openings in the hub that extend entirely through the hub, so that the stop members are able to project out of both a front and a rear surface of the hub whereby each stop member can be extended its full length from the hub in either direction along a central axis of each stop member.

10. The apparatus of claim 8 wherein the hub is removably secured to the apparatus for allowing the hub to be removed with the stop members retained thereon so as to maintain the stop members in selected positions, thereby minimizing set-up time when the hub is re-used.

11. The apparatus of claim 8 wherein the stop members are screw-threaded within the hub and the distance each stop member extends from the hub can be adjusted from a front side of the apparatus closest to the worktable, and an opposite end of each stop member is positioned to contact the bumper during operation for positioning the worktable at a selected stop point.

12. A linear positioning system for a positioning actuator assembly including a cylinder and a movable piston, said assembly being operatively connected to a worktable for moving the worktable along a rectilinear path, an indexing actuator assembly comprising a cylinder and a piston therein, both of said actuator assemblies being connectable to a fluid power source for operating the said actuator assemblies, at least one stop member which is movable to an operating position that is located so as to stop the movement of the worktable at a selected stop point, the indexing actuator assembly is operatively associated with all such stop members for imparting step-wise motion thereto to select one stop member to stop the movement of the worktable at a selected stop point, and each stop member is a threaded element screw-threaded into a threaded hole in the apparatus so as to be extensible thereon by being threaded into or out of the threaded hole to a selected position for establishing a selected stop point for the worktable.

13. The apparatus of claim 12 wherein a plurality of said stop members are supported in a plurality of said threaded holes within a rotatable hub.

14. The apparatus of claim 13 wherein each said stop member is spaced radially from an axis of rotation of said hub and is positioned parallel thereto.

15. A positioning apparatus for a worktable, said apparatus comprising:

a stationary supporting framework, a pair of slide rods slidably mounted on the framework and supporting the worktable for rectilinear movement imparted by a pneumatic positioning actuator that is not capable of precisely positioning the worktable, a bumper connected to the slide rods, a stop assembly comprising a hub mounted for rotation on the framework and having at least one threaded hole therein, a stop member comprising a threaded element screw-threaded into the threaded hole in the hub so as to be movable in the hub by being threaded into or out of the threaded hole within the hub to a selected position to thereby establish a selected stop point for the worktable, an actuator mounted on the framework and operatively associated with the hub for rotating the hub to move the threaded stop member into the path of the bumper connected to the slide rods for engaging the bumper to stop the movement of the worktable at a selected stop point by blocking further movement of the worktable while the pneumatic actuator continues to force the bumper against the stop member.

16. The apparatus of claim 15 wherein a plurality of said stop members are supported in a plurality of said threaded holes within said hub and each such stop member is selectively movable into the path of the bumper.

17. The apparatus of claim 16 wherein each said threaded stop member is spaced radially from an axis of rotation of said hub and is positioned parallel to said hub axis.

18. The apparatus of claim 16 wherein the actuator comprises an indexing actuator connected to the hub for imparting a step-wise rotary indexing motion to the hub for positioning a selected one of said stop members in the path of the worktable.

19. The apparatus of claim 18 wherein a one-way clutch is connected between the indexing actuator and the hub such that repeated operation of the indexing actuator imparts said step-wise rotary motion to the hub.

20. The apparatus of claim 15 wherein the positioning actuator is affixed to the framework and said positioning actuator includes a movable actuator rod that is connected to the worktable such that the operation of the positioning actuator extends to retracts the actuator rod to impact movement to the worktable.

21. A positioning apparatus for a worktable, said apparatus comprising:

a stationary supporting framework, a pair of slide rods slidably mounted on the framework and supporting the worktable for rectilinear movement imparted by a pneumatic positioning actuator that is not capable of precisely positioning the worktable, a bumper connected to the slide rods, a stop assembly comprising a hub movably mounted on the framework and having at least one threaded hole therein, a stop member comprising a threaded element screw-threaded into the threaded hole in the hub so as to be movable in the hub by being threaded into or out of the threaded hole within the hub to a selected position to thereby establish a selected stop point for the worktable, an actuator mounted on the framework and operatively associated with the hub for shifting the hub to move the threaded stop member into the path of the bumper connected to the slide rods for engaging the bumper to stop the movement of the worktable at a selected stop point by blocking further movement of the worktable while the pneumatic actuator continues to force the bumper against the stop member.

* * * * *